US007803201B2

(12) United States Patent
Zhou et al.

(10) Patent No.: US 7,803,201 B2
(45) **Date of Patent: *Sep. 28, 2010**

(54) ORGANICALLY COMPLEXED NANOCATALYSTS FOR IMPROVING COMBUSTION PROPERTIES OF FUELS AND FUEL COMPOSITIONS INCORPORATING SUCH CATALYSTS

(75) Inventors: Bing Zhou, Cranbury, NJ (US); Sukesh Parasher, Lawrenceville, NJ (US); Michael Rueter, Plymouth Meeting, PA (US); Zhihua Wu, Plainsboro, NJ (US)

(73) Assignee: Headwaters Technology Innovation, LLC, Lawrenceville, NJ (US)

( * ) Notice: Subject to any disclaimer, the term of this patent is extended or adjusted under 35 U.S.C. 154(b) by 998 days.

This patent is subject to a terminal disclaimer.

(21) Appl. No.: 11/104,324

(22) Filed: Apr. 12, 2005

(65) Prior Publication Data

US 2006/0175230 A1 Aug. 10, 2006

Related U.S. Application Data

(63) Continuation-in-part of application No. 11/054,196, filed on Feb. 9, 2005.

(51) Int. Cl.
*C10L 10/00* (2006.01)
*C10L 1/10* (2006.01)

(52) U.S. Cl. ..... 44/603; 431/2

(58) Field of Classification Search ..... 44/603; 431/2

See application file for complete search history.

(56) References Cited

U.S. PATENT DOCUMENTS

| | | | | |
|---|---|---|---|---|
| 3,332,755 | A * | 7/1967 | Kukin | 44/603 |
| 3,656,901 | A * | 4/1972 | Kummerle | 502/8 |
| 3,839,225 | A | 10/1974 | Acres | 252/432 |
| 3,864,451 | A | 2/1975 | Lee et al. | 423/239 |
| 3,885,020 | A | 5/1975 | Whelan | 423/245 |
| 3,900,428 | A | 8/1975 | Mai et al. | 252/462 |
| 3,925,001 | A | 12/1975 | Salooja | 431/4 |
| 3,926,854 | A | 12/1975 | Whelan et al. | 252/462 |
| 3,947,380 | A | 3/1976 | Whelan et al. | 252/462 |
| 3,976,599 | A | 8/1976 | Whelan | 252/462 |
| 3,987,146 | A | 10/1976 | Clay et al. | |
| 4,082,837 | A | 4/1978 | Whelan | 423/405 |
| 4,088,606 | A | 5/1978 | Fedor et al. | 252/465 |
| 4,108,761 | A | 8/1978 | Sze et al. | |
| 4,158,044 | A | 6/1979 | Takabatake et al. | 423/235 |
| 4,273,749 | A | 6/1981 | Kimura et al. | |
| 4,289,737 | A | 9/1981 | Acres et al. | 423/245 |
| 4,331,638 | A | 5/1982 | Michelfelder | 423/210 |
| 4,366,085 | A | 12/1982 | Ikegami et al. | |
| 4,374,105 | A | 2/1983 | Anderson et al. | |
| 4,375,949 | A | 3/1983 | Salooja | |
| 4,397,321 | A | 8/1983 | Stuetz | |
| 4,433,065 | A | 2/1984 | van der Burgt et al. | |
| 4,513,098 | A | 4/1985 | Tsao | |
| 4,515,092 | A | 5/1985 | Walsh et al. | 110/347 |
| 4,581,344 | A | 4/1986 | Ledoux et al. | |
| 4,591,430 | A | 5/1986 | Hudson | |
| 4,804,388 | A | 2/1989 | Kukin | 44/51 |
| 4,824,360 | A | 4/1989 | Janka et al. | |
| 4,836,117 | A | 6/1989 | Teller et al. | 110/342 |
| 4,842,617 | A | 6/1989 | Kukin | 44/51 |
| 4,843,980 | A | 7/1989 | Markham et al. | 110/342 |
| 4,880,378 | A | 11/1989 | Hums | |
| 4,966,882 | A | 10/1990 | Kato et al. | |
| 5,024,905 | A | 6/1991 | Itoh et al. | |
| 5,055,029 | A | 10/1991 | Avidan et al. | 431/7 |
| 5,087,600 | A | 2/1992 | Kato et al. | |
| 5,110,452 | A | 5/1992 | Meyer et al. | |
| 5,118,282 | A | 6/1992 | Reynolds et al. | 431/4 |
| 5,132,099 | A | 7/1992 | Hiramatsu et al. | |

(Continued)

FOREIGN PATENT DOCUMENTS

| | | |
|---|---|---|
| DE | 3317504 | 11/1984 |

(Continued)

OTHER PUBLICATIONS

Z. Wu and Y. Ohtsuka, Key Factors for Formation of N2 from Low-Rank Coals during Fixed Bed Pyrolysis: Pyrolysis Conditions and Inherent Minerals, 11 Energy & Fuels 902-908 (1997).*

(Continued)

*Primary Examiner*—Glenn Caldarola
*Assistant Examiner*—Randy Boyer
(74) *Attorney, Agent, or Firm*—Workman Nydegger

(57) ABSTRACT

Organically complexed nanocatalyst compositions are applied to or mixed with a carbon-containing fuel (e.g., tobacco, coal, briquetted charcoal, biomass, or a liquid hydrocarbon like fuel oils or gasoline) in order to enhance combustion properties of the fuel. Nanocatalyst compositions can be applied to or mixed with a solid fuel substrate in order to reduce the amount of CO, hydrocarbons and soot produced by the fuel during combustion. In addition, coal can be treated with inventive nanocatalyst compositions to reduce the amount of $NO_x$ produced during combustion (e.g., by removing coal nitrogen in a low oxygen pre-combustion zone of a low NOx burner). The nanocatalyst compositions include nanocatalyst particles made using a dispersing agent. They can be formed as a stable suspension to facilitate storage, transportation and application of the catalyst nanoparticles to a fuel substrate.

31 Claims, 2 Drawing Sheets

U.S. PATENT DOCUMENTS

| | | | | |
|---|---|---|---|---|
| 5,176,088 | A | 1/1993 | Amrhein et al. | 110/345 |
| 5,211,684 | A | 5/1993 | Shannon et al. | |
| 5,338,531 | A | 8/1994 | Chuang et al. | |
| 5,378,443 | A | 1/1995 | Engström et al. | |
| 5,384,301 | A | 1/1995 | Flytzani-Stephanopoulos et al. | |
| 5,419,286 | A | 5/1995 | Edison et al. | 123/1 A |
| 5,516,741 | A | 5/1996 | Gascoyne et al. | |
| 5,580,839 | A | 12/1996 | Huffman et al. | |
| 5,597,771 | A | 1/1997 | Hu et al. | 502/304 |
| 5,612,010 | A | 3/1997 | Pandey et al. | |
| 5,662,051 | A | 9/1997 | Morin | 110/344 |
| 5,671,758 | A | 9/1997 | Rongved | |
| 5,705,053 | A | 1/1998 | Buchanan | |
| 5,740,667 | A | 4/1998 | Bhattacharyya et al. | |
| 5,756,059 | A | 5/1998 | Zamansky et al. | 423/239.1 |
| 5,823,758 | A | 10/1998 | Lack | 431/4 |
| 5,846,898 | A | 12/1998 | Chuang et al. | |
| 5,866,501 | A | 2/1999 | Pradhan et al. | |
| 5,871,638 | A | 2/1999 | Pradhan et al. | |
| 5,899,678 | A | 5/1999 | Thomson et al. | 431/2 |
| 5,925,588 | A | 7/1999 | Chuang et al. | |
| 5,936,134 | A | 8/1999 | Mastral Lamarca et al. | |
| 5,967,061 | A | 10/1999 | Ashworth et al. | 110/203 |
| 6,007,699 | A | 12/1999 | Cole | |
| 6,054,507 | A | 4/2000 | Funaki et al. | |
| 6,090,858 | A * | 7/2000 | El-Sayed | 502/339 |
| 6,127,307 | A | 10/2000 | Muller et al. | |
| 6,159,267 | A | 12/2000 | Hampden-Smith et al. | 75/252 |
| 6,168,775 | B1 | 1/2001 | Zhou et al. | |
| 6,194,338 | B1 | 2/2001 | Andolfatto et al. | |
| 6,206,685 | B1 | 3/2001 | Zamansky et al. | |
| 6,280,695 | B1 | 8/2001 | Lissianski et al. | |
| 6,401,634 | B1 | 6/2002 | Anderson | 110/342 |
| 6,471,506 | B1 | 10/2002 | Zamansky et al. | |
| 6,494,153 | B1 | 12/2002 | Lyon | |
| 6,528,683 | B1 | 3/2003 | Heidemann et al. | |
| 6,534,661 | B1 | 3/2003 | Zhou et al. | |
| 6,551,960 | B1 | 4/2003 | Laine et al. | |
| 6,572,761 | B2 | 6/2003 | Lyon | |
| 6,612,249 | B2 | 9/2003 | Sanders | 110/345 |
| 6,676,919 | B1 | 1/2004 | Fischer et al. | |
| 6,706,902 | B2 | 3/2004 | Stürmann et al. | 549/523 |
| 6,716,525 | B1 | 4/2004 | Yadav et al. | 428/402 |
| 6,740,133 | B2 | 5/2004 | Hundley, Jr. | 44/301 |
| 6,740,615 | B2 | 5/2004 | Zhou | |
| 6,746,597 | B2 | 6/2004 | Zhou et al. | |
| 6,776,606 | B2 | 8/2004 | Haskew | 431/2 |
| 6,782,892 | B2 | 8/2004 | Li et al. | |
| 6,923,945 | B2 | 8/2005 | Chen | 423/239.1 |
| 2003/0005622 | A1 | 1/2003 | Hundley | 44/443 |
| 2004/0007241 | A1 | 1/2004 | Li et al. | 131/334 |
| 2004/0013601 | A1 | 1/2004 | Butz et al. | |
| 2004/0037770 | A1 | 2/2004 | Fischer et al. | |
| 2004/0168365 | A1 | 9/2004 | Hundley | 44/603 |
| 2004/0241502 | A1 | 12/2004 | Chung et al. | |
| 2005/0016057 | A1 | 1/2005 | Factor et al. | |
| 2005/0039382 | A1 * | 2/2005 | Blanchard et al. | 44/362 |
| 2005/0060929 | A1 * | 3/2005 | Caprotti et al. | 44/354 |
| 2005/0108925 | A1 | 5/2005 | Jurng et al. | 44/457 |
| 2005/0109356 | A1 | 5/2005 | Reddy et al. | 131/334 |
| 2005/0257724 | A1 | 11/2005 | Guinther et al. | 110/345 |
| 2006/0117651 | A1 | 6/2006 | Hundley | 44/641 |

FOREIGN PATENT DOCUMENTS

| | | |
|---|---|---|
| JP | 4-136601 | 5/1992 |
| JP | 4-136602 | 5/1992 |
| WO | WO 98/45037 | 10/1998 |
| WO | WO 02/058825 | 8/2002 |
| WO | WO 02/83550 | 10/2002 |
| WO | WO 03053560 A1 * | 7/2003 |
| WO | WO 03/086115 | 10/2003 |
| WO | WO 2004/110184 | 12/2004 |
| WO | WO 2005/039327 | 5/2005 |
| WO | WO 2005/039328 | 5/2005 |

OTHER PUBLICATIONS

A. B. R. Mayer et al., Colloidal Platinum-Polyacid Nanocatalyst Systems, 259 Die Angewandte Makromolekulare Chemie 45-53 (1998).*

Wang, H.P., et al., "Spectroscopic Studies of Coal Maceral Depolymerization Effected by an Iron-Based Catalystl" U.S. Department of Energy 1992, http://www-acerc.byu.edu/Abstracts/19. (1992).

Asami, Kenji, et al., "Highly Active Iron Catalysts from Ferrie Chloride for the Steam Gasification of Brown Coal" *American Chemical Society*, Ind. Eng. Chem. Res. 1993, 32, pp. 1631-1636.

Ohtsuka, Yasuo, et al., Selective Conversion of Coal Nitrogen to $N_2$ with Iron , Research Center for Carbonaceous Resources, Institute for Chemical Reaction Science, Tohoku, Japan, pp. 1095-1096 (Aug. 3, 1993).

Ohtsuka, Yasuo, et al., "Nitrogen Removal During Atmospheric-Pressure Pyrolysis of Brown Coal with Iron" *Fuel*, 1994, vol. 73 No. 7, pp. 1093-1097.

Mori, Hiroshi, et al., "Role of Iron Catalyst in Fate of Fuel Nitrogen during Coal Pyrolysis" Institute for Chemical Reaction Science, Tohoku University, Sendai, Japan, pp. 1022-1027 (Mar. 6, 1996).

Ahmadi, et al., "Shape-Controlled Synthesis of Colloidal Platinum Nanoparticles" *Science*, vol. 272, pp. 1924-1926 (Jun. 28, 1996).

Wu, Zhiheng, et al., Remarkable Formation of $N_2$ from a Chinese Lignite during Coal Pyrolysis, Research Center for Carbonaceous Resources, Institute for Chemical Reaction Science, Tohoku, Japan, pp. 1280-1281 (Aug. 20, 1996).

Wu, Zhiheng, et al., "Nitrogen Distribution in a Fixed Bed Pyrolysis of Coals with Different Ranks: Formation and Source of $N_2$" Institute for Chemical Reaction Science, Tohoku University, Sendai, Japan, pp. 447-482 (Aug. 5, 1996).

Wu, Zhiheng, et al., "Formation of Nitrogen-Containing Compounds during Slow Pyrolysis and Oxidation of Petroleum Coke" Institute for Chemical Reaction Science, Tohoku University, Sendai, Japan, (Jan. 17, 1997).

Wu, Zhiheng, et al., "Key Factors for Formation of $N_2$ from Low-Rank Coals during Fixed Bed Pyrolysis: Pryolysis Conditions and Inherent Minerals" Institute for Chemical Reaction Science, Tohoku University, Sendai, Japan, pp. 902-908 (Feb. 4, 1997).

Ohtsuka, Yasuo, et al., "Char-Nitrogen Functionality and Interactions between the Nitrogen and Iron in the Iron-Catalyzed Conversion Process of Coal Nitrogen to $N_2$" Research Center for Organic Resources and Material s Chemistry, Institute for Chemical Reaction Science, Tohoku University, Sendai, Japan, pp. 1356-1362, (May 6, 1998).

Wu, Zhiheng, et al., "Catalytic Nitrogen Release During a Fixed-Bed Pyrolysis of Model Coals Containing Pyrrolic or Pyridinic Nitrogen" Surface Chemistry Department, National Institute of Material and Chemical Research, Tsukuba, Japan, Energy Resource Department, National Institute and Environment, Tsukuba, Japan, pp. 251-254 (Sep. 16, 1999).

Li, et al., "Carbon Nanotubes as Support for Cathode Catalyst of a Direct Methanol Fuel Cell", *Letters to the Editor/Carbon 40*, Dalian University of Technology, pp. 787-803 (Jan. 18, 2002).

Tsubouchi, Naoto, et al., "Nitrogen Release During High Temperature Pyrolysis of Coals and Catalytic Role of Calcium in $N_2$ Formation", Research Center for Sustainable Material Engineering, Institute of Multidisciplinary Research for Advanced Material, Tohoku, Japan, pp. 2335-2342 (Mar. 20, 2002).

Li, et al., "Preparation and Characterization of Multiwalled Carbon Nanotube-Supported Platinum for Cathode Catalysts of Direct Methanol Fuel Cells", *J. Phys. Chem*, B, vol. 107, pp. 6292-6299 (Jun. 6, 2003).

Lordi, et al., "Method for Supporting Platinum on Single-Walled Carbon Nanotubes for a Selective hydrogenation Catalyst", *Chem. Mater.*, vol. 13, pp. 733-737 (Feb. 10, 2001).
Zhou, et al., "Novel Synthesis of Highly Active Pt/C Cathode Electrocatalyst for Direct Methanol Fuel Cell" Chem. Commun. 2003, pp. 394-395.
Zhou, et al. "Preparation and Characterization of Anode Catalysts PtRu/C for Direct Methanol Fuel Cells" Chemical Journal of Chinese Universities, vol. 24, 2003, pp. 885-862.

* cited by examiner

ORGANICALLY COMPLEXED NANOCATALYSTS FOR IMPROVING COMBUSTION PROPERTIES OF FUELS AND FUEL COMPOSITIONS INCORPORATING SUCH CATALYSTS

CROSS-REFERENCE TO RELATED APPLICATION

This application is a continuation-in-part of copending U.S. application Ser. No. 11/054,196, filed Feb. 9, 2005, the disclosure of which is incorporated herein in its entirety.

BACKGROUND OF THE INVENTION

1. The Field of the Invention

The present invention relates to organically complexed nanocatalysts for use in improving the combustion properties of fuels. The present invention also relates to modified fuels that incorporate such organically complexed nanocatalysts, as well as methods for manufacturing such nanocatalysts and fuel compositions incorporating such catalysts.

2. Related Technology

Carbon-containing fuels typically combust to yield mainly carbon dioxide and water as the major products of combustion. Due to incomplete combustion, however, other more harmful molecules can be formed, such as carbon monoxide (CO), hydrocarbons and soot. Impurities in the fuel can also yield significant quantities of ash, $SO_x$ and $NO_x$. Due to increased environmental awareness and stricter governmental guidelines, there are ongoing efforts to reduce the release of harmful emissions into the environment.

Coal combustion is major source of energy for the production of electricity throughout the world. Coal is a good source of energy because of its high energy to weight ratio and its great abundance. The use of coal, however, is increasingly under scrutiny because of environmental concerns. Among the known environmental difficulties with coal combustion is the production and emission of $NO_x$ compounds, such as NO, $N_2O$, and $NO_2$. $NO_x$ compounds can be very harmful to human health and are known to produce undesirable environmental effects such as smog.

Government regulations require emission from coal burning to be monitored and controlled. Controlling $NO_x$ emissions has become increasingly difficult as government regulations continue to lower the allowable level of $NO_x$ and other pollutants that can be released into the environment. The requirement for reduced pollutants from coal-fired power plants has led to a demand for suitable new technologies.

In a coal fired power plant, there are two principle sources of $NO_x$ formation: fuel $NO_x$ and thermal $NO_x$. Fuel $NO_x$ is $NO_x$ that forms from nitrogen found in the fuel, whereas thermal $NO_x$ is formed from other sources of nitrogen such as nitrogen in the air. About 80% of $NO_x$ emissions from coal combustion are produced from fuel nitrogen.

One method used to reduce pollutants during coal combustion focuses on removing $NO_x$ from power plant flue gas. For example, $NO_x$ emitted in flue gas can be removed using selective catalytic reduction (SCR), which converts $NO_x$ compounds to nitrogen gas ($N_2$) and water. However, this type of $NO_x$ control method is expensive, in part, because of the required capital investment. The cost of these technologies and increasingly stringent government regulations have created a need for less expensive technologies to reduce $NO_x$ emissions from coal combustion.

Another method of reducing $NO_x$ emissions is to remove coal nitrogen from the coal material by converting it to $N_2$.

Recently, researchers have discovered that iron-based catalysts can assist in releasing fuel nitrogen from coal. In work by Ohtsuka and coworkers at Tohoku University (Sendai, Japan), methods have been described for the production of an iron-based catalyst, which, when combined with coal and placed in an pyrolysis environment, causes nitrogen compounds in coal to be released more rapidly, thus causing a decrease in the amount of nitrogen remaining in the char material (Ohtsuka et al., Energy and Fuels 7 (1993) 1095 and Ohtsuka et al., Energy and Fuels 12 (1998) 1356).

Several features of the catalyst and methods used by Ohtsuka make Ohtsuka's catalyst and methods too expensive and less effective than desired for use in coal fired power plants. First, Ohtsuka teaches precipitating a $FeCl_3$ solution directly onto the coal using $Ca(OH)_2$. Precipitating the catalyst onto the coal results in intimate contact between the coal and the catalyst precursors and other reagents used to make the catalyst nanoparticles. While Ohtsuka suggests washing the coal to remove chloride and calcium, this step requires washing the entire coal feedstream, which would be very costly on an industrial scale. Furthermore, at least some of these chemicals are likely to be adsorbed by the coal and remain even after washing. Introducing compounds such as chloride and calcium can have an adverse effect on power plant equipment and can cause pollution themselves.

In addition, precipitating the catalyst onto the coal requires that the catalyst be formed in the same location as the coal. This limitation could require that the catalyst be prepared at a coal mine or power plant, or that the coal material be shipped to a separate facility for catalyst preparation, thereby adding to production costs.

Another disadvantage of Ohtsuka's catalyst is that it requires high loading amounts to obtain desired results (e.g., up to 7% by weight of iron). High loading amounts can increase costs and offset the benefits of using a relatively inexpensive material such as iron. In addition, high iron content contributes to ash formation and/or can alter the ash composition.

Other solid fuels that emit pollutants into the environment include charcoal, wood and biomass, commonly due to incomplete combustion. Typical pollutants from these fuels include CO and hydrocarbons. Another substance that is a solid "fuel" is tobacco, which is deliberately combusted in a way so as to yield smoke that is inhaled or puffed into the body. In addition to desired large molecules, such as nicotine, tobacco combustion produces undesired small molecules such as CO and nitric oxide (NO). More information related to tobacco and efforts to reduce the formation of undesired small molecules are set forth in copending U.S. application Ser. No. 11/054,196, filed Feb. 9, 2005, which was previously incorporated by reference.

What is needed are improved catalysts that can be applied to or combined with solid fuels, such as coal, charcoal, wood, biomass, tobacco, or fuel oils to reduce undesired pollutants during combustion.

BRIEF SUMMARY OF THE INVENTION

The present invention provides nanocatalyst compositions that can be applied to or mixed with a fuel in order to improve the combustion properties of the fuel. The disclosed catalyst compositions more particularly include organically complexed nanocatalyst particles having a size less than 1 micron that can be applied to or mixed with fuels such as tobacco, coal, briquetted charcoal, wood, biomass, or hydrocarbon liquids (e.g. jet fuel, diesel, heavy fuel oils, and gasoline) in order to improve the combustion properties of such fuels.

For example, nanocatalysts according to the invention can be applied to tobacco in order to reduce the amount of small molecules that are generated during the chemical degradation of the tobacco material that occurs when the tobacco is consumed (e.g., in a burning cigarette, cigar, or pipe). When blended with tobacco, the inventive organically complexed nanocatalysts can selectively eliminate undesirable small molecules, such as CO and NO, while allowing desirable large flavor-bearing molecules to remain substantially unchanged. Such selectivity may be controlled by exposing a specific crystal structure of the catalyst.

In another embodiment, organically complexed nanocatalysts according to the invention can be applied to or mixed with coal in order to increase the conversion of coal nitrogen (i.e., nitrogen fixed as part of a coal substance rather than from the air) to nitrogen gas prior to or during combustion. In addition, the inventive organically complexed nanocatalyst particles may be expected to increase the combustion efficiency of coal and/or other fuels such as briquetted charcoal, wood, biomass (e.g., waste stocks from harvested grain, wood mill by-products, hemp, and plant material grown specifically for combustion as biomass) and hydrocarbon liquids (e.g. heavy fuel oil, diesel, jet fuel, and gasoline).

According to one aspect of the invention, a catalyst complex comprising a plurality of active catalyst atoms complexed with a dispersing agent is formed preliminarily. The catalyst complex may comprise a solution, colloid, or a suspension of nanoparticles. The active catalyst atoms typically include one or more of iron, chromium, manganese, cobalt, nickel, copper, zirconium, tin, zinc, tungsten, titanium, molybdenum, and vanadium. The dispersing agent typically includes organic molecules that include one or more functional groups selected from the group of a hydroxyl, a carboxyl, a carbonyl, an amine, an amide, a nitrile, an amino acid, a thiol, a sulfonic acid, an acyl halide, a sulfonyl halide, or a nitrogen with a free lone pair of electrons.

According to one embodiment, the catalyst complex comprises a suspension of organically complexed nanocatalyst particles having a size less than about 1 micron as a suspension within a solvent. The nanocatalyst particles typically have a concentration greater than about 1% by weight of the suspension, preferably greater than about 5% by weight of the suspension, more preferably greater than about 7.5% by weight, and most preferably greater than about 10% by weight of the suspension.

One advantage of the suspension of organically complexed nanocatalyst particles according to the invention is that the nanocatalyst particles are stable such that the suspension can be easily stored and transported without substantial agglomeration of the nanocatalyst particles. This allows a catalyst composition according to the invention to be prepared, stored, and then transported as needed, thus obviating the need to form the catalyst on-site at the time it is applied to a fuel substrate. The catalyst suspension may be applied using simple techniques, such as spraying, which adds negligible to minimal cost to the operation of, e.g., a coal-fired power plant.

According to another aspect of the invention, a fuel composition is provided comprising a fuel substrate and a plurality of organically complexed nanocatalyst particles on and/or mixed with said fuel substrate. As discussed above, the fuel substrate may comprise tobacco, coal, coal briquettes, wood, biomass, or a liquid hydrocarbon such as fuel oils and gasoline. The organically complexed nanocatalyst particles on and/or mixed with the fuel substrate have a size less than 1 micron. In the case where the fuel substrate is tobacco, the nanocatalyst particles are preferably less than about 100 nm in size, more preferably less than about 10 nm, even more preferably less than about 6 nm, and most preferably less than about 4 nm. In the case where the fuel is coal, charcoal briquettes, wood, biomass, or liquid hydrocarbon, the nanocatalyst particles are preferably less than about 300 nm in size, more preferably less than about 100 nm, even more preferably less than about 50 nm, and most preferably less than about 10 nm.

Another feature of fuel compositions according to the invention is that the dispersing agent binds to at least a portion of the catalyst atoms and prevents or inhibits agglomeration of the nanocatalyst particles during combustion, pyrolysis, or other high temperature conditions to which the fuel compositions may be exposed. Thus, the organically complexed nanocatalyst particles according to the invention have greater stability under extreme temperature conditions compared to conventional metal catalysts. The dispersing agent acts to stabilize the nanocatalyst particles and prevents deactivation. In some cases, the nanocatalyst particles may even be anchored to the fuel substrate, thereby preventing or inhibiting sintering or agglomeration of the catalyst of the combustion process itself. Preventing agglomeration of the nanocatalyst particles maintains the benefit of nano-sized catalyst particles for longer periods of time compared to conventional catalysts.

The organically complexed nanocatalyst compositions according to the invention also increase catalyst efficiency, thereby allowing for lower catalyst loadings within a fuel composition and/or increasing catalyst activity. The dispersion and stability of the nanocatalyst particles increases the activity of the catalyst such that lower amounts of the catalyst can be loaded while still providing a desired level of catalytic activity.

In the case where the organically complexed nanocatalyst composition is used with coal, the stability of the nanocatalyst particles on the coal material and the efficacy with which the catalyst can assist in converting coal nitrogen to $N_2$ allows the nanocatalyst composition to be mixed with the coal material in significantly lower concentrations than has been accomplished heretofore. The nanocatalyst composition can be mixed with the coal before or after pulverizing the coal preparatory to combustion. The catalyst complex can be applied to coal or other fuel using low-cost equipment, such as pumps and sprayers.

In an exemplary embodiment, the nanocatalyst composition is loaded onto the coal material with a catalyst loading of less than about 2.5% by weight of the coal product. In a more preferred embodiment, the catalyst loading is less than about 1.5% by weight. Minimizing catalyst loading significantly reduces the cost of treating the coal and can also reduce the risk of damaging power plant equipment. Minimizing catalyst metal loading can also reduce the risk of adversely affecting commercially valuable byproducts, such as fly ash, produced during coal combustion. catalyst metal loading can also reduce the risk of adversely affecting commercially valuable byproducts, such as fly ash, produced during coal combustion.

In an exemplary method according to the present invention, a catalyst complex is formed by: (i) providing a plurality of active catalyst atoms; (ii) providing a dispersing agent that includes at least one functional group selected from the group consisting of a hydroxyl, a carboxyl, a carbonyl, an amine, an amide, a nitrile, nitrogen with a lone pair of electrons, an amino acid, a thiol, a sulfonic acid, sulfonyl halide, and an acyl halide; and (iii) reacting the catalyst atoms and the dispersing agent to form the catalyst complex, which may be in the form of a solution, colloid, or suspension. In one embodiment, the catalyst complex includes a plurality of organically complexed nanocatalyst particles having a size less than 1 micron in suspension within a solvent.

Forming a nanocatalyst suspension from ground state metal atoms instead of an iron salt (e.g., iron chloride or nitrate) can be advantageous because ground state metals are devoid of undesirable anions. A salt form of iron, such as iron chloride or nitrate, can produce a catalyst composition with heteroatoms, such as chloride or nitrate ion, which may need to be removed from the nanocatalyst composition before use. By using a ground state metal as a precursor, use of significant amounts of heteroatoms can be avoided. This feature avoids the expense of subsequent washing of the coal or other fuel and the difficulties of corrosion, fouling, and other side effects of having heteroatoms in the fuel.

Notwithstanding the foregoing, it should be understood that the present invention can be carried out using metal salts, though this is less preferred. Whether the heteroatoms have an adverse effect can depend on the particular system in which the nanocatalyst composition is used and the particular hetoratoms produced in the catalyst These and other advantages and features of the present invention will become more fully apparent from the following description and appended claims as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION OF THE PREFERRED EMBODIMENTS

I. Introduction and Definitions

Figure 1:
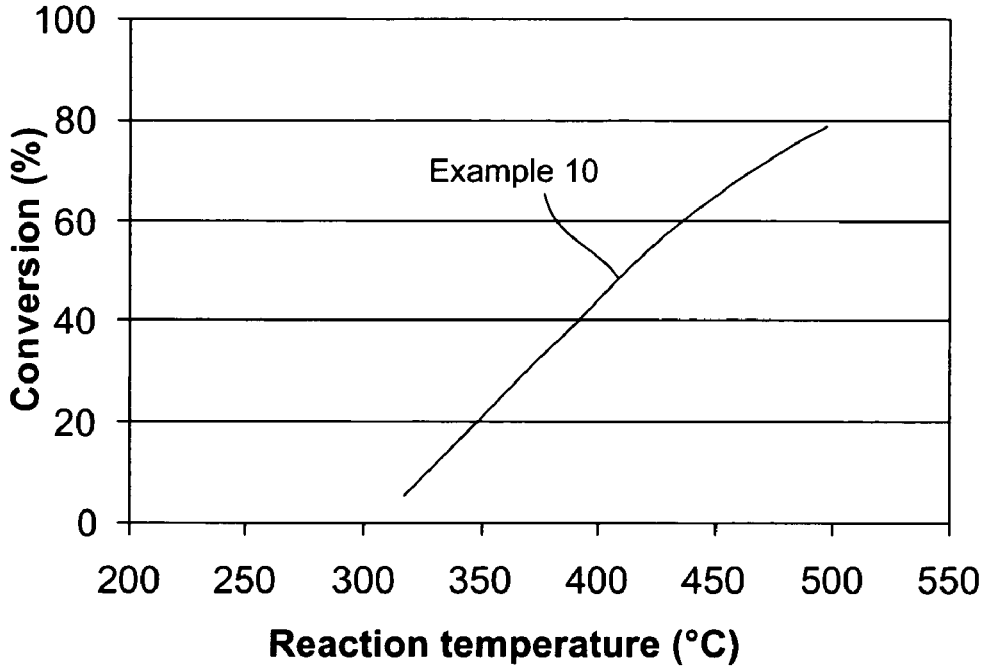
FIG. 1 is a graph showing carbon monoxide conversion during tobacco combustion using the catalyst of Example 10.

The present invention encompasses organically complexed nanocatalyst compositions for use with a fuel in order to improve the combustion properties of the fuel. The combination of organically complexed nanocatalyst particles and a fuel substrate forms a fuel composition within the scope of the invention. The invention also encompasses methods for manufacturing catalyst complexes, organically complexed nanocatalyst particles, and fuel compositions that include such nanocatalyst compositions.

Organically complexed nanocatalyst particles according to the invention have a size less than 1 micron and can be applied to or mixed with carbon-containing fuels such as tobacco, coal, briquetted charcoal, wood, biomass, and liquid hydrocarbons in order to improve the combustion properties of such fuels. In the case of tobacco, the inventive nanocatalyst compositions provide for the conversion of carbon monoxide and nitric oxide to safer substances such as carbon dioxide and nitrogen. The nanocatalyst compositions would be expected to reduce the formation of carbon monoxide and nitric oxide in other carbon-containing fuels, such as coal, briquetted charcoal, wood, biomass, and liquid hydrocarbons. In the case of coal, the inventive nanocatalyst compositions may also provide the added benefit of helping to convert coal source nitrogen into nitrogen gas in a low oxygen portion of a coal burner (e.g., in a conventional low NOx burner).

For purposes of this disclosure and the appended claims, the term "tobacco" includes both natural tobacco and tobacco substitutes which are combustible and designed to mimic natural tobacco in one or more aspects, such as chemical stimulation and/or burning properties.

The term "tobacco smoke" means the mixture of gases and particulates given off as the tobacco composition undergoes combustion, pyrolysis, and/or heating.

For purposes of this disclosure, the term "catalyst" does not exclude atoms, molecules, and/or particles that are consumed in a reaction, such as the degradation of unwanted molecules in tobacco smoke or during combustion of another carbon-based fuel, such as coal, briquetted charcoal, wood, biomass, or fuel oils. For example, in some embodiments, the catalysts of the present invention may be consumed by reduction or oxidation during combustion or other high temperature operations.

The terms "briquetted charcoal" and "charcoal briquettes" shall refer to solid pieces of charcoal comprising individual charcoal particles that are bonded, compacted, or otherwise held together so as to be something other than a pulverized powder. In general, the terms "briquetted charcoal" and "charcoal briquettes" shall refer to any form of charcoal other than "activated charcoal", "activated carbon" and "carbon black," as those terms are defined in the art.

The term "biomass" refers to any plant-derived fuel material from any plant source whatsoever. Examples include waste stocks, leaves, or other materials from grains, husks, shells, or other materials resulting from the harvesting and processing of grains, nuts, fruits, or other edible plant products. It also refers to hemp, grass, leaves, stocks, or other plant materials specifically grown for the purpose of producing biomass fuel. It includes wood chips, sawdust, or other scrap materials resulting from the milling or processing of lumber and other wood products, and the like.

The term "carbon-based fuel" or "fuel substrate" shall refer to any solid, or semi-solid, viscous liquid, or liquid fuel material, but shall exclude forms of carbon that, though possibly flammable or combustible, are not in a form or produced at a sufficiently low cost to make them primarily usable as a fuel (i.e., carbon black, activated charcoal, or activated carbon designed for use as a filtration or scavenging material

II. Organically Complexed Catalyst Compositions

Organically complexed nanocatalyst compositions include a catalyst complex formed by reacting one or more active catalyst atoms and a dispersing agent and, optionally, a solvent. The catalyst complex may be in the form of nanocatalyst particles or may be a precursor thereto. The organically complexed nanocatalyst compositions according to the invention may be in the form of a solution, colloid, or suspension when mixed with a solvent, or they may be in the form of a concentrated or dried material upon removal of the solvent. The dried composition can be reconstituted so as to form a solution, colloid, or suspension upon reintroducing one or more solvents into the composition.

A. Catalyst Complexes

Catalyst complexes according to the invention include one or more different types of active catalyst atoms complexed with one or more different types of dispersing agents. When so complexed, the catalyst atoms are arranged in such a manner that the catalyst atoms either (i) form dispersed nanocatalyst particles in solution or suspension or (ii) that upon contact with a fuel substrate and/or after undergoing further processing, the catalyst complexes form dispersed nanocatalyst particles. In either case, the dispersing agent can form a catalyst complex to produce nanoparticles that are dispersed, stable, uniform, and/or desirably sized.

1. Active Catalyst Atoms

The active catalyst atoms useful in practicing the present invention are metal atoms or elements, such as iron or other metals, that can form nanocatalyst particles capable of catalyzing desired reactions during combustion of the fuel (e.g., the conversion of $NO_x$ to non-polluting gases such as $N_2$ in the case of coal and/or the conversion of CO to $CO_2$ and NO to $N_2$ during combustion of any carbon-based fuel, such as tobacco, coal, briquetted charcoal, wood, biomass, and fuel oil). These include elements or groups of elements that exhibit primary catalytic activity, as well as promoters and modifiers.

As the primary active catalyst component, base transition metals are preferred due to their valence characteristics and/or their relatively low cost compared to noble metals and rare earth metals. Examples of base transition metals that exhibit catalytic activity when mixed with a fuel include iron, chromium, manganese, cobalt, nickel, copper, zirconian, tin, zinc, tungsten, titanium, molybdenum, and vanadium. Among the foregoing, titanium is less preferred for use in improving combustion characteristics of tobacco, briquetted charcoal, wood, and biomass. In the case of coal, particularly where it is desired to assist in reducing coal nitrogen to nitrogen gas prior to combustion, preferred catalyst metals include one or more of iron, nickel, cobalt, manganese, vanadium, copper, and zinc.

The primary catalysts listed above may be used alone or in various combinations with each other or in combination with other elements, such as noble metals, rare earth metals, alkaline metals, alkaline earth metals, or even non-metals.

In general, the primary active catalyst component will comprise at least about 50% of the active catalyst atoms in the catalyst complex. This percentage measures the actual number of catalyst atoms or their molar ratio. In a preferred embodiment, at least 50% of the active catalyst atoms are iron. Iron is typically preferred as the primary active catalyst because of its low cost and also because of its electron valence characteristics. The iron catalyst atoms may be provided in the form of iron metal, iron chloride, iron sulfate, iron nitrate, or other iron salts. The iron catalyst precursor may either be insoluble in an aqueous medium, as in the case of iron metal, or it may be soluble, as in the case of iron chloride and other iron salts. In a preferred embodiment, iron metal is used in order to avoid incorporating compounds that include the anion of the iron salt.

The catalyst atoms may also include a minority metal component to modify or promote the catalytic function of the above mentioned metals. Examples of minority metals that can be added to the catalyst composition in addition to the primary catalyst component include ruthenium, palladium, silver, platinum, nickel, cobalt, vanadium, chromium, copper, zinc, molybdenum, tin, manganese, gold, rhodium, zirconium, tungsten, rhenium, osmium, iridium, titanium, cerium and the like. These components can be added in metal form or as a salt.

Optionally non-transition metals can also be included, typically as promoters or modifiers. Suitable non-transition metals include alkali metals and alkali earth metals, such as sodium, potassium, magnesium, calcium, etc., and non-metals such as phosphorus, sulfur, and halides.

2. Dispersing Agents

In addition to catalyst atoms, the catalyst complexes of the present invention include one or more dispersing agents. The dispersing agent is selected to promote the formation of nanocatalyst particles that have a desired stability, size and/or uniformity. Dispersing agents within the scope of the invention include a variety of small organic molecules, polymers and oligomers. The dispersing agent is able to interact and bond with catalyst atoms dissolved or dispersed within an appropriate solvent or carrier through various mechanisms, including ionic bonding, covalent bonding, Van der Waals interaction/bonding, lone pair electron bonding, or hydrogen bonding.

To provide the bonding between the dispersing agent and the catalyst atoms, the dispersing agent includes one or more appropriate functional groups. In one embodiment, the functional group(s) comprise a carbon atom bonded to at least one electron-rich atom that is more electronegative than the carbon atom and that is able to donate one or more electrons so as to form a bond or attraction with a catalyst atom. Preferred dispersing agents include functional-groups which have either a charge or one or more lone pairs of electrons that can be used to complex a metal catalyst atom, or which can form other types of bonding such as hydrogen bonding. These functional groups allow the dispersing agent to have a strong binding interaction with the catalyst atoms.

The dispersing agent may be a natural or synthetic compound. In the case where the catalyst atoms are metal and the dispersing agent is an organic compound, the catalyst complex so formed may be an organometallic complex.

In an exemplary embodiment, the functional groups of the dispersing agent comprise one or more members selected from the group of a hydroxyl, a carboxyl, a carbonyl, an amine, an amide, a nitrile, a nitrogen with a free lone pair of electrons, an amino acid, a thiol, a sulfonic acid, a sulfonyl halide, and an acyl halide. The dispersing agent can be monofunctional, bifunctional, or polyfunctional.

Examples of suitable monofunctional dispersing agents include alcohols such as ethanol and propanol and carboxylic acids such as formic acid and acetic acid. Useful bifunctional dispersing agents include diacids such as oxalic acid, malic acid, malonic acid, maleic acid, succinic acid, and the like; dialcohols such as ethylene glycol, propylene glycol, 1,3-propanediol, and the like; hydroxy acids such as glycolic acid, lactic acid, and the like. Useful polyfunctional dispersing agents include sugars such as glucose, polyfunctional carboxylic acids such as citric acid, pectins, cellulose, and the like. Other useful dispersing agents include ethanolamine, mercaptoethanol, 2-mercaptoacetate, amino acids, such as glycine, and sulfonic acids, such as sulfobenzyl alcohol, suflobenzoic acid, sulfobenzyl thiol, and sulfobenzyl amine. The dispersing agent may even include an inorganic component (e.g., silicon-based).

Suitable polymers and oligomers within the scope of the invention include, but are not limited to, polyacrylates, polyvinylbenzoates, polyvinyl sulfate, polyvinyl sulfonates including sulfonated styrene, polybisphenol carbonates, polybenzimidizoles, polypyridine, sulfonated polyethylene terephthalate. Other suitable polymers include polyvinyl alcohol, polyethylene glycol, polypropylene glycol, and the like.

In addition to the characteristics of the dispersing agent, it can also be advantageous to control the molar ratio of dispersing agent to the catalyst atoms in a catalyst suspension. A more useful measurement is the molar ratio between dispersing agent functional groups and catalyst atoms. For example, in the case of a divalent metal ion two molar equivalents of a monovalent functional group would be necessary to provide the theoretical stoichiometric ratio. In the case where the fuel is coal, charcoal, wood, biomass, or a liquid hydrocarbon, the molar ratio of dispersing agent functional groups to catalyst atoms is preferably in a range of about 0.001:1 to about 50:1, more preferably in a range of about 0.005:1 to about 10:1, and most preferably in a range of about 0.01:1 to 1:1. In the case where the fuel is tobacco, the molar ratio of dispersing agent functional groups to catalyst atoms is preferably in a range of about 0.01:1 to about 40:1, more preferably in a range of about 0.1:1 to about 30:1, and most preferably in a range of about 0.5:1 to about 20:1.

The dispersing agents of the present invention allow for the formation of very small and uniform nanoparticles. In general, the nanocatalyst particles formed in the presence of the dispersing agent are less than 1 micron in size. In the case where the nanocatalyst composition is used within a tobacco fuel composition, the nanocatalyst particles are preferably less than about 100 nm in size, more preferably less than about 10 nm, even more preferably less than about 6 nm, and most preferably less than about 4 nm. In some cases, the nanocatalyst particles may approach the atomic scale. In the case where the fuel composition includes coal, briquetted charcoal, wood, biomass, or a liquid hydrocarbon, the nanocatalyst particles are preferably less than about 300 nm in size, more preferably less than about 100 nm, even more preferably less than about 50 nm, and most preferably less than about 10 nm.

Finally, depending on the desired stability of the nanocatalyst particles within the fuel composition, the dispersing agent can be selected in order to act as an anchor between the nanocatalyst particles and the fuel substrate. While the dispersing agent has the ability to inhibit agglomeration of the nanocatalyst particles in the absence of anchoring, chemically bonding the nanocatalyst particles to the fuel substrate surface by means of the dispersing agent is an additional and particularly effective mechanism for preventing agglomeration.

During thermal degradation and combustion of the fuel composition, the dispersing agent can inhibit deactivation of the nanocatalyst particles. This ability to inhibit deactivation can increase the temperature at which the nanocatalysts can perform and/or increase the useful life of the nanocatalyst in the extreme conditions of combustion, e.g., in a coal burner, an industrial burner, backyard barbeque, campfire, or cigarette. Even if including the dispersing agent only preserves catalytic activity for a few additional milliseconds, or even microseconds, the increased duration of the nanocatalyst can be very beneficial at high temperatures, given the dynamics of fuel combustion and pollution formation.

Depending on the type of fuel composition and/or the manner in which the fuel composition is to be utilized, the organically complexed nanocatalyst particles may be applied or anchored to a support material apart from the fuel substrate. The use of a support material may be advantageous in order to more fully and completely disperse the organically complexed nanocatalyst particles throughout the fuel material. The support material may result in a more active nanocatalyst particle by providing more active sites per unit of catalyst material.

B. Solvents and Other Additives

The liquid medium in which the organically complexed nanocatalyst composition is prepared may contain various solvents, including water and organic solvents. Solvents participate in catalyst formation by providing a solution for the interaction of catalyst atoms and dispersing agent. In some cases, the solvent may act as a secondary dispersing agent in combination with a primary dispersing agent that is not acting as a solvent. In one embodiment, the solvent also allows the nanoparticles to form a suspension, as described more fully below. Suitable solvents include water, methanol, ethanol, n-propanol, isopropyl alcohol, acetonitrile, acetone, tetrahydrofuran, ethylene glycol, dimethylformamide, dimethylsulfoxide, methylene chloride, and the like, including mixtures thereof.

The selection of a particular solvent is often dictated by cost. While there may in some instances be certain advantages in the use of organic solvents, the cost of either recovering the organic solvent or allowing the organic solvent to be consumed with the catalyst during combustion of the coal may result in a significant economic disadvantage for the use of organic solvents. Therefore, liquids which contain mostly or entirely water are the preferred solvents for the present invention.

However, if an organic solvent is used, the solvent can be recovered using known methods such as distillation. Alternatively, if the organic solvent is not recovered, it can provide some fuel value when consumed during coal combustion.

The catalyst composition can also include additives to assist in the formation of the nanocatalyst particles. For example, mineral acids and basic compounds can be added, preferably in small quantities (e.g. less than 5 wt %). Examples of mineral acids that can be used include hydrochloric acid, nitric acid, sulfuric acid, phosphoric acid, and the like. Examples of basic compounds include sodium hydroxide, potassium hydroxide, calcium hydroxide, ammonium hydroxide, and similar compounds.

It is also possible to add solid materials to assist in nanoparticle formation. For example, ion exchange resins may be added to the solution during catalyst formation. Ion exchange resins can be substituted for the acids or bases mentioned above. Solid materials can be easy separated from the final iron catalyst solution or suspension using simple techniques such as centrifugation and filtration.

Solid materials can also be added to remove unwanted byproducts. For example, activated carbon is a relatively inexpensive material that can be used to remove some unwanted by-products from the catalyst preparation.

C. Supports and Support Materials

Organically complexed nanocatalyst particles can be isolated on a support surface if desired. In an exemplary embodiment, the nanocatalyst particles are supported by the fuel substrate itself. According to one embodiment, the fuel substrate may include functional groups to which the dispersing agent can bond.

Alternatively, the organically complexed nanocatalyst particles can be formed on a separate solid support. The support may be organic or inorganic. It may be chemically inert, or it may serve a catalytic function complementary to the nanocatalyst. The support may be in a variety of physical forms. It may be porous or nonporous. It may be a three-dimensional structure, such as a powder, granule, tablet, or extrudate. The support may be a two-dimensional structure such as a film, membrane, or coating. It may be a one-dimensional structure such as a narrow fiber. In the case of a cigarette, the solid support may be a filter attached to and forming part of the cigarette, or it may be some other part of the cigarette such as the paper which forms the outer wrapping.

One class of support materials includes porous, inorganic materials, such as alumina, silica, titania, kieselguhr, diatomaceous earth, bentonite, clay, zirconia, magnesia, metal oxides, zeolites, and calcium carbonate. Another useful class of supports include carbon-based materials, such as carbon black, activated carbon, graphite, fluoridated carbon, and the like. Other supports include polymers and other inorganic solids, metals, and metal alloys. Organic supports are advantageous in the case where it is desired for the support to burn up with the fuel substrate.

In the case where the nanocatalyst particles are attached to a support, they may be deposited within a wide range of loadings on the support material. The loading can range from about 0.01% to about 70 wt % of the supported nanocatalyst particles exclusive of the fuel substrate, more preferably in a range of about 0.1% to about 25%. In the case where the support material is porous, it is preferable for the surface area to be at least 20 $m^2/g$, more preferably greater than 50 $m^2/g$.

III. Methods of Making Nanocatalyst Compositions and Particle Suspensions

The process for manufacturing organically complexed nanocatalyst particles can be broadly summarized as follows. First, one or more types of catalyst atoms and one or more types of dispersing agents are selected. Second, the catalyst atoms (e.g., in the form of a ground state metal or metal salt) and dispersing agent (e.g., in the form of a carboxylic acid salt) are reacted or combined together to form a catalyst complex. The catalyst complex is generally formed by first dissolving the catalyst atoms and dispersing agent in an appropriate solvent or carrier and then allowing the catalyst atoms to recombine as the catalyst complex so as to form a solution, colloid, or suspension. The various components may be combined or mixed in any sequence or combination. In addition, a subset of the components can be premixed prior to addition of other components, or all components may be simultaneously combined.

In one aspect of the invention, the catalyst complex may be considered to be the complexed catalyst atoms and dispersing agent, exclusive of the surrounding solvent or carrier. Indeed, it is within the scope of the invention to create a catalyst complex in a solution, a colloid, or a suspension, and then remove the solvent or carrier so as to yield a dried catalyst complex. The dried catalyst complex can be applied to and/or mixed with a fuel substrate in such a form, or can be reconstituted as a solution, colloid, or suspension by adding an appropriate solvent.

In an exemplary embodiment, the components are mixed for a period of about 1 hour to about 5 days. This mixing is typically conducted at temperatures ranging from 0° C. to 200° C. Preferably the temperature does not exceed 100° C. The preparation of the catalyst complex is typically exothermic, so provisions for cooling may be used to control the temperature. The temperature can be held at a constant value throughout the mixing step, or it can be programmed to change during the mixing period.

The preparation of the catalyst complex can evolve hydrogen gas, which can require provisions for handling the gas pressure. Normally, the mixing step will be conducted at or near atmospheric pressure, although elevated pressure may be needed in cases where the mixing is conducted at elevated temperature, especially those exceeding the normal boiling point of the liquid mixture. In one embodiment, an inert gas flow may be provided to safely purge any evolved gases from the mixing apparatus.

According to one currently preferred embodiment, the catalyst atoms used to form nanocatalyst particles comprise iron metal. Using iron metal can be advantageous because iron metal does not form an anion by-product. After mixing with the dispersing agents and optional additives, the iron metal is converted to an active catalyst form and becomes dissolved or suspended in the solvent. Typically the only significant by-product of the catalyst preparation using iron metal is hydrogen gas, which is evolved during the mixing procedure.

In another embodiment, the catalyst atoms are provided as precursors in the form of an iron salt such as iron chloride, iron nitrate, iron sulfate, and the like. These compounds are soluble in an aqueous solvent. However, formation of the catalyst nanoparticles leads to the formation of additional by-products from the release of the anion in the iron salt.

The anion-containing by-product may remain in the catalyst mixture; however, it is usually beneficial to remove the by-product to prevent the heteroatoms from having deleterious effects on equipment used in coal combustion. In the case where the byproduct is in solid form, it may be removed by filtration, centrifugation, or the like. In the case where the byproduct is in liquid form, the byproduct can be removed by distillation, absorption, adsorption, extraction, ion exchange, membrane separation, or the like.

In an exemplary embodiment, the nanocatalyst particles are in an active form once the mixing step is complete. In a preferred embodiment, the nanocatalyst particles are formed as a suspension of stable active iron nanocatalyst particles. The stability of the nanocatalyst particles prevents the particles from agglomerating together and maintains them in suspension. Even where some or all of the nanocatalyst particles settle out of suspension over time, the nanocatalyst particles can be easily re-suspended by mixing. The stable suspension is particularly advantageous because it can be shipped, stored, transported, and easily applied to a fuel substrate (e.g., tobacco, a coal stream, briquetted charcoal, wood, biomass, or a liquid hydrocarbond).

Because of the strong price pressures on energy production, the cost effective production and application of the nanocatalyst compositions to a fuel substrate may be important in maintaining the economic viability of their use. In one embodiment, the low cost of iron-based precursors, solvent, and dispersing agents are particularly beneficial for minimizing cost.

In one embodiment of the present invention, the concentration of metal catalyst in the suspension may be increased to reduce shipping costs, to more easily apply the catalyst composition to a fuel substrate, and/or improve catalyst performance. Typically, the nanocatalyst solution colloid or suspension contains at least about 1% by weight active catalyst atoms. In a preferred embodiment, the final catalyst solution or suspension contains at least about 5% by weight of active catalyst atoms, more preferably at least about 7.5% active catalyst atoms by weight, and most preferably at least about 10% active catalyst atoms by weight. In one embodiment, the nanocatalyst composition is dried and then reconstituted prior to use, as discussed above.

IV. Fuel Compositions and Related Methods

Fuel compositions according to the invention include at least one type of carbon-containing fuel substrate and at least one type of organically complexed nanocatalyst applied on or mixed with the fuel substrate. Exemplary fuel substrates include tobacco, coal, briquetted charcoal, wood, biomass, and liquid hydrocarbons, such as diesel, jet fuel, heavy fuel oils, and gasoline. The complexed nanocatalyst particles can be applied to or mixed with a fuel substrate using any desired method, including dipping, spraying, mixing, compacting, etc.

The organically complexed nanocatalyst particles improve one or burn properties or characteristics of the fuel, e.g., reducing CO, NO, and unburned hydrocarbons and soot in any fuel. In the case of coal, the organically complexed nanocatalyst particles may also assist in removing and converting coal nitrogen to nitrogen gas prior to combustion in a low oxygen zone of a burner (e.g., within a conventional low NOx burner).

A. Tobacco Compositions and Articles

Organically complexed nanocatalyst particles can be combined with tobacco to make enhanced tobacco compositions and articles, such as cigarettes and cigars. The complexed nanocatalyst particles are associated with the tobacco such that upon combustion and/or pyrolysis of the tobacco, the smoke produced therefrom comes into contact with the nanocatalyst particles. The nanocatalyst particles help degrade the undesirable small molecules (e.g., CO and NO) before the smoke is inhaled by a user. Most tobaccos can be used with the present invention.

The complexed nanocatalyst particles of the present invention can be placed anywhere in or on a smoking article so long as smoke can come into contact with the nanoparticles during use. In an exemplary embodiment, supported and/or unsupported complexed nanocatalyst particles are associated with a tobacco material by positioning, them sufficiently close to gasses in tobacco smoke that the nanocatalyst can perform its catalytic function. The complexed nanocatalyst particles can be directly mixed with the tobacco material. Alternatively, they can be associated with the tobacco material by being deposited between the tobacco material and the filter of a cigarette. The complexed nanocatalyst particles can be disposed within the filter or be present in or on tobacco paper used to make a cigarette.

Because the complexed nanocatalyst particles are stable and highly active, catalyst loadings applied to the tobacco and/or filter can be significantly lower than catalyst loadings in the prior art. In an exemplary embodiment, the complexed nanocatalyst particles comprise iron mixed with a tobacco material with a metal loading less than about 30% by weight of the tobacco composition, more preferably less than about 15% by weight, and most preferably less than about 5% by weight.

In one embodiment, it is possible for the complexed nanocatalyst particles, at elevated temperatures, to be consumed in a redox reaction. In yet another embodiment, the complexed nanocatalyst particles can perform a catalytic function at one temperature and an oxidative and/or reductive function at another temperature.

Temperatures in a burning cigarette can reach temperatures between 200° C. and 900° C. At such temperatures, traditional catalyst particles can sinter and agglomerate to form larger particles, which can deactivate the catalyst particles by reducing the surface area available for catalysis and/or oxidation or reduction. In contrast, the nanocatalyst particles of the present invention are complexed with an organic complexing agent, such as glycolic acid, which help prevent or at least delay agglomeration and catalyst deactivation sufficiently as to be effective to increase combustion efficiency.

In one embodiment, the dispersing agent allows the nanocatalyst particles to operate at a higher temperature, which can have significant benefits. Higher operating temperatures can increase catalytic activity, thus reducing the amount of required catalyst. In some cases, proper catalytic activity can only be obtained at higher temperatures. Thus higher operating temperatures can provide opportunities for using new catalysts. Alternatively, the dispersing agent increases the length of time before the nanocatalyst particles are destroyed in combustion or pyrolysis. In this embodiment, the dispersing agent's ability to inhibit deactivation allows the nanocatalyst particles sufficient time to degrade undesirable small molecules before being consumed.

The tobacco compositions can be made into cigarettes, cigars or other forms of inhalable tobacco using methods known in the art. An organically complexed catalyst composition in a suspension can be sprayed or otherwise directly mixed with a tobacco material. Likewise, if the complexed nanocatalyst particles are supported on a support surface, the support material can be mixed with the tobacco. Tobacco compositions within the scope of the invention may further comprise one or more flavorants or other additives (e.g., burn additives, combustion modifying agents, coloring agents, binders, etc.) known in the art.

B. Coal Compositions

The catalyst compositions of the present invention can be combined with coal to make a modified coal composition having improved burn properties. In one embodiment complexed nanocatalyst particles applied to or mixed with coal can assist in reducing the emission of $NO_x$ during combustion. The catalyst compositions can be combined with almost any type of coal material. Suitable coal materials include anthracite, bituminous, subbituminous, and lignite coals.

Any method can be used to apply the catalyst composition to the coal material. The catalyst composition can be directly mixed with the coal by spraying or using any other mixing technique. Complexed nanocatalyst nanoparticles in the form of a suspension are particularly easy to apply using a spraying technique.

The amount of catalyst applied to coal may be expressed in terms of weight percent of the metal catalyst (e.g., iron) by weight of the overall coal composition. Coal compositions typically include an iron loading of between about 0.1% and about 10% by weight of the overall coal composition. In a preferred embodiment, the metal (e.g., iron) loading is preferably less than about 5% by weight of the coal composition, more preferably less than about 2.5% by weight, and most preferably less than about 1.5% by weight.

The complexed nanocatalyst compositions of the invention have sufficient catalytic activity that catalyst loadings can be limited sufficiently to avoid problems with high iron concentrations. For example, high quantities of iron can present potential deposition problems in a boiler due to the fluxing abilities of the iron. The fly ash chemistry can also change with high iron loading. High iron loadings may also have an effect on corrosion of coal combustion equipment. By limiting the iron loading in the coal compositions of the present invention, the risks of these potential problems is reduced.

Coal compositions within the scope of the invention are designed to be used in combination with low NOx burners and over fire air ports. These technologies create a fuel-rich pyrolysis zone within a boiler that provides favorable conditions for the catalytic conversion of fuel nitrogen to harmless nitrogen gas. While not being limited to any particular theory, it is currently believed that the inventive organically complexed nanocatalyst compositions promote the increase of nitrogen release rates within high volatile eastern bituminous coal during the devolatization stage of a low NOx burner. This fuel-rich zone promotes the conversion of fuel nitrogen to nitrogen gas. Once converted to nitrogen gas, the nitrogen becomes more resistant to oxidation to form NOx. Therefore, when the pyrolyzed coal mixture passes into the combustion zone, nitrogen is much less likely to be converted to NOx compounds than the original coal compounds would be. This substantially reduces the overall generation of NOx during coal combustion.

Coal burners are typically designed to burn coal that has been pulverized. Those skilled in the art are readily familiar with coal burners, pulverizers, and related systems used to burn coal. According to one method of the present invention, a catalyst composition as described above is applied directly to the coal prior to pulverization. In this embodiment, applying the catalyst composition to the coal is very simple because the coal can be readily accessed. For example, the catalyst composition can be applied to coal on a conveyer. The nanocatalyst compositions may be applied to coal prior to combustion by "direct injection" or "mixing". In "direct injection", the catalyst is applied to the vertical coal stream located between the pulverizer and the burners. In "mixing", the catalyst is sprayed on the coal as it is conveyed prior to entering the pulverizer.

In an alternative embodiment, the catalyst composition is applied after the pulverizer but before the coal stream reaches the coal burner. Applying the catalyst composition to the coal stream can be somewhat more difficult after pulverization because there is more limited access to the pulverized coal.

In one embodiment, injectors are installed into the tubing of the coal feedstream and the catalyst composition is sprayed into the pulverized coal feed stream. Applying the catalyst composition directly into the pulverized feedstream can be advantageous because the catalyst composition can be better mixed initially since the coal has a small particle size.

In yet another embodiment, the catalyst composition and the pulverized coal material are injected individually into an oxygen depleted portion of a coal burner. In an exemplary embodiment, the catalyst material is sprayed into the burner with the coal material such that the catalyst nanoparticles and the pulverized coal material are sufficiently mixed such that the catalyst nanoparticles can catalyze the removal of coal nitrogen from the coal material within the oxygen depleted portion.

C. Other Fuel Compositions

The foregoing discussion of tobacco and coal compositions can be extended to other carbon-containing fuels such as briquetted charcoal, wood, biomass, and liquid hydrocarbons. Catalyst loadings in such fuels will typically be similar to those discussed above with respect to coal.

V. Examples of Fuel Compositions for Use in Reducting Pollutants During Combustion The following are various examples of inventive fuel compositions made using inventive organically complexed nanocatalyst compositions according to the invention. Examples stated in the past tense are actual examples of catalyst and fuel compositions that have been manufactured and/or used according to the invention. Examples recited in the present tense are hypothetical examples of catalyst and fuel compositions that could be manufactured and/or used according to the invention. Some examples may even include both actual and hypothetical aspects. Even though an example may be a hypothetical in nature, or include a hypothetical portion, it should be understood that all examples are based on or extrapolated from actual compositions that have been made and/or tested.

Examples 1-9 describe supported nanocatalyst compositions that can be used with a fuel substrate to improve burn properties (e.g., a tobacco material to reduce undesirable small molecules in tobacco smoke). Examples 10-18 describe test results that illustrate the ability of the nanocatalyst compositions of Examples 1-9, respectively, to convert carbon monoxide to carbon dioxide.

Example 1

A precursor liquid was prepared by mixing together 0.56 g of iron powder, 1.8 g of dextrose, 1.92 g of citric acid, and 100 g of water. The components were mixed until all solids were dissolved. The precursor liquid was added to 5.0 g of gamma-alumina with a BET surface area of 83 $m^2/g$ while stirring. The mixture of liquid and solid was heated to 90° C. while stirring until the slurry volume was reduced to about 30 ml by evaporation. The supported iron nanocatalyst sample was placed in a rotating drier under a heat lamp until dry. The solid material was further dried in an oven at 80° C. for 2 hrs. The supported nanocatalyst, which comprised 6% iron on an alumina support, can be applied to or mixed with any fuel substrate and was found to be useful when mixed or associated with tobacco.

Example 2

A precursor liquid was prepared by mixing 0.112 g of iron powder, 1.114 g of a 0.010 wt. % Pt solution (prepared by mixing 0.2614 g of $H_2PtCl_6$ in 1000 ml water), 0.36 g of dextrose, 0.384 g of citric acid, and 100 g of water. The components were mixed until all solids were dissolved. The precursor liquid was added to 5.0 g of the alumina support in Example 1. The mixture of liquid and solid was heated to 90° C. with stirring until the slurry volume was reduced to about 30 ml by evaporation. The supported iron-platinum nanocatalyst sample was placed in a rotating drier under a heat lamp until dry. The solid material was further dried in an oven at 80° C. for 2 hrs. The dried powder was reduced under hydrogen flow for 6 hours at 300° C. The supported nanocatalyst, which comprised 0.2% iron and 22 ppm platinum on an alumina support, can be applied to or mixed with any fuel substrate and was found to be useful when mixed or associated with tobacco.

Example 3

The catalyst of this example was prepared using the same procedure as Example 2, except that the alumina support was substituted with calcium carbonate having a surface area of 6 $m^2/g$. The supported nanocatalyst, which comprised 0.2% iron and 22 ppm platinum on a calcium carbonate support, can be applied to or mixed with any fuel substrate and was found to be useful when mixed or associated with tobacco.

Example 4

A precursor liquid was prepared by mixing 0.56 g of iron powder, 5.57 g of the 0.010 wt. % platinum solution used in Example 2, 1.8 g of dextrose, 1.92 g of citric acid, and 100 g of water. The components were mixed until all solids were dissolved. The precursor liquid was added to 5.0 g of the alumina support in Example 1. The mixture was heated and dried by the same procedure described in Example 1. The supported nanocatalyst, which comprised 6% iron and 60 ppm platinum on an alumina support, can be applied to or mixed with any fuel substrate and was found to be useful when mixed or associated with tobacco.

Example 5

The catalyst of this example was prepared using the same procedure employed in Example 4, except that the alumina support material was substituted with 5.0 g of calcium carbonate of the same type used in Example 3. The supported nanocatalyst, which comprised 6% iron and 60 ppm platinum on a calcium carbonate support, can be applied to or mixed with any fuel substrate and was found to be useful when mixed or associated with tobacco.

Example 6

0.80 g NaOH was dissolved in 40 ml of ethylene glycol to form a first solution, and 0.72 g of $Fe(NO_3)_3.9H_2O$ was dissolved in 10 ml ethylene glycol to form a second solution. The two solutions were mixed together. 1.54 g of $CaCO_3$ of the type used in Example 3 was added to the resulting mixture. 50 ml of a 1.0 M aqueous $NH_4NO_3$ solution was added to the above solution, and the mixture of liquids was aged for 2 hours to form a precursor composition. The precursor composition was filtered and the precipitate washed 3 times with water. The precipitate was dried at 70° C. in a vacuum oven for 3 hours, followed by further drying at 80° C. in a drying oven for 2 hours. The supported nanocatalyst, which comprised 6% iron on a calcium carbonate support, can be applied to or mixed with any fuel substrate and was found to be useful when mixed or associated with tobacco.

Example 7

A precursor liquid was created by mixing 75 ml of a first solution (prepared by mixing 1.3339 g $PdCl_2$ in 4.76 g HCl and then diluting to 1000 ml using water), 12 ml of a second solution (prepared by mixing 0.2614 g of $H_2PtCl_6$ with 1000 ml of water), and 10 ml of a third solution (prepared by diluting 15 g of 45% polyacrylate sodium salt solution (MW=1200) to a total mass of 100 g with water). The precursor liquid was diluted to 500 ml with water and stirred in a vessel fitted with a gas inlet, to which nitrogen is fed for 1 hour, followed by hydrogen for 20 minutes.

0.167 g of the above precursor liquid was diluted to 16.67 g with water. The diluted liquid was mixed with 0.20 g of the 6% Fe on $CaCO_3$ catalyst of Example 6. The mixture of liquid and solid was heated to 80° C. with stirring until dry. The solid was further dried at 80° C. in a drying oven for 2 hours. The supported nanocatalyst, which comprised 6% iron and 1 ppm palladium on a calcium carbonate support, can be applied to or mixed with any fuel substrate and was found to be useful when mixed or associated with tobacco.

Example 8

1.67 g of the precursor liquid in Example 7 was diluted to 16.7 g with water and added to 0.20 g of the 6% Fe on $CaCO_3$ catalyst of Example 6. The mixture of liquid and solid was heated to about 80° C. with stirring until dry. The solid was further dried at 80° C. in a drying oven for 2 hours. The supported nanocatalyst, which comprised 6% iron and 10 ppm palladium on a calcium carbonate support, can be applied to or mixed with any fuel substrate and was found to be useful when mixed or associated with tobacco.

Example 9

16.67 g of the precursor liquid in Example 7 was added, without further dilution, to 0.20 g of the 6% Fe on $CaCO_3$ catalyst of Example 6. The mixture of liquid and solid was heated to about 80° C. with stirring until dry. The solid was further dried at 80° C. in a drying oven for 2 hours. The supported nanocatalyst, which comprised 6% iron and 100 ppm palladium on a calcium carbonate support, can be applied to or mixed with any fuel substrate and was found to be useful when mixed or associated with tobacco.

Examples 10-18

The catalysts of Examples 1-9 were tested for CO oxidation activity in Examples 10-18, respectively. Each of Examples 10-18 were conducted identically. In each case, 100 mg of supported nanocatalyst was mixed with quartz wool and then packed into a quartz flow tube. The flow tube was placed in a tubular furnace, and subjected to a flow of gas containing 2.94% by volume of carbon monoxide, 21% by volume oxygen, and the balance nitrogen at a total flow rate of 1000 sccm. A thermocouple was placed in the catalyst zone to continuously monitor the reaction temperature. The reactor temperature was ramped at a rate of 12° C. per minute.

The exiting gas was periodically sampled and tested by gas chromatography to determine the amount of carbon monoxide remaining at a series of temperatures spanning the temperature range of the experiment. The carbon monoxide fractional conversion at each temperature was calculated as the molar amount of carbon monoxide consumed divided by the molar amount of carbon monoxide in the feed gas. This was then converted to a percent conversion by multiplying by 100.

The results of Examples 10-18 are summarized in Table I below:

TABLE I

| Example 10 | | Example 11 | | Example 12 | | Example 13 | | Example 14 | |
|---|---|---|---|---|---|---|---|---|---|
| Temp. (° C.) | Conv. (%) | Temp. (° C.) | Conv. (%) | Temp. (° C.) | Conv. (%) | Temp. (° C.) | Conv. (%) | Temp. (° C.) | Conv. (%) |
| 317 | 5 | 363 | 0 | 368 | 2 | 318 | 3 | 323 | 0 |
| 345 | 18 | 388 | 1 | 394 | 6 | 349 | 20 | 348 | 6 |
| 374 | 32 | 414 | 9 | 430 | 41 | 387 | 49 | 376 | 21 |
| 402 | 46 | 460 | 84 | 473 | 86 | 421 | 71 | 405 | 51 |
| 428 | 57 | 482 | 100 | 495 | 90 | 448 | 81 | 436 | 65 |
| 453 | 66 | | | | | 472 | 86 | 462 | 75 |
| 474 | 73 | | | | | 493 | 89 | 487 | 82 |

TABLE I-continued

| | | | | | | | |
|---|---|---|---|---|---|---|---|
| 498 | 79 | | | | | 513 | 100 |
| Example 15 | | Example 16 | | Example 17 | | Example 18 | |
| Temp. (° C.) | Conv. (%) | Temp. (° C.) | Conv. (%) | Temp. (° C.) | Conv. (%) | Temp. (° C.) | Conv. (%) |
| 288 | 16 | 278 | 10 | 279 | 10 | 272 | 7 |
| 317 | 24 | 304 | 17 | 312 | 32 | 339 | 90 |
| 345 | 32 | 333 | 26 | 359 | 64 | 384 | 95 |
| 371 | 39 | 359 | 33 | 389 | 74 | | |
| 397 | 45 | 387 | 41 | 415 | 77 | | |
| 422 | 49 | 413 | 46 | 438 | 78 | | |
| 448 | 55 | 436 | 50 | 463 | 78 | | |
| 471 | 59 | 483 | 60 | 484 | 79 | | |
| 496 | 63 | 508 | 65 | | | | |

Figure 2:
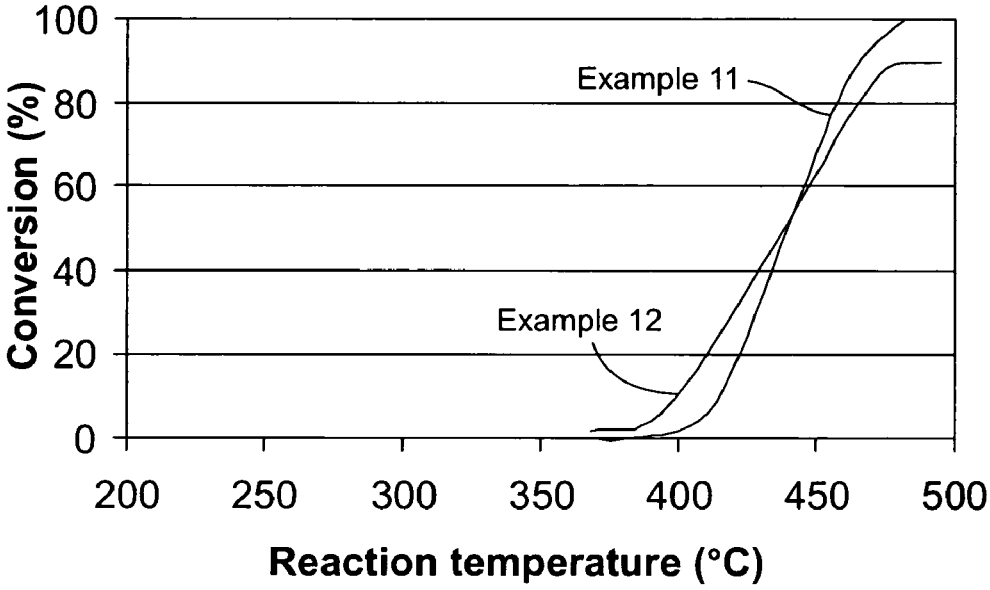
FIG. 2 is a graph showing carbon monoxide conversion during tobacco combustion using the catalysts of Examples 11 and 12.
Figure 3:
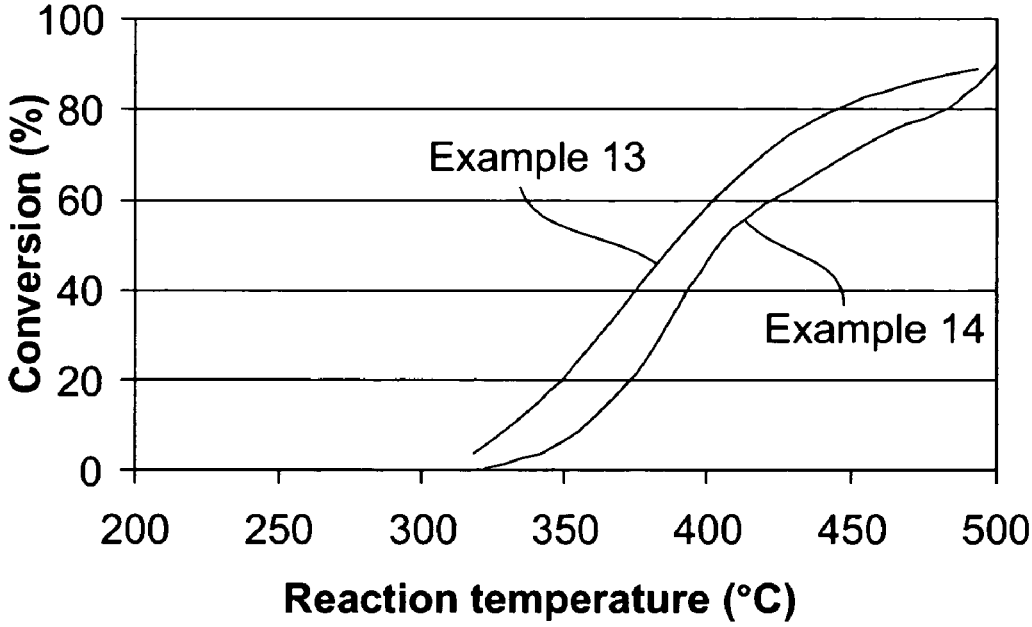
FIG. 3 is a graph showing carbon monoxide conversion during tobacco combustion using the catalysts of Examples 13 and 14.
Figure 4:
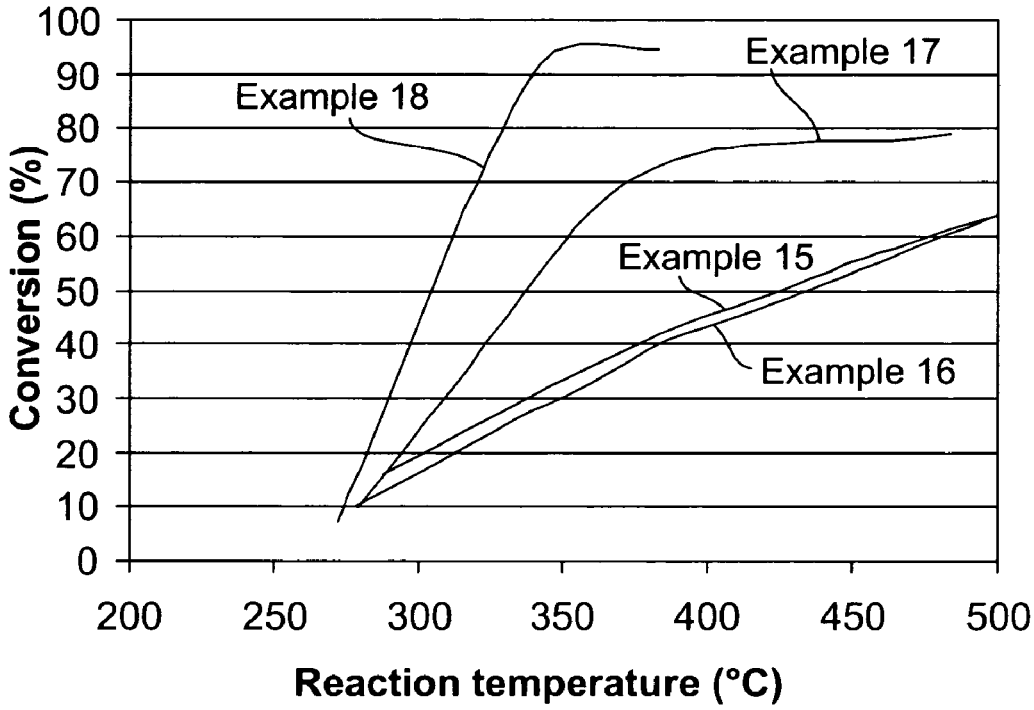
FIG. 4 is a graph showing carbon monoxide conversion during tobacco combustion using the catalysts of Examples 15, 16, 17 and 18.

FIGS. 1-4 are graphs that illustrate the results of Examples 10-18. FIGS. 1-4 shows the conversion of carbon monoxide to carbon dioxide at various temperatures. FIG. 1 shows conversion for an iron catalyst on an alumina support. FIG. 2 illustrates the difference in conversion of carbon monoxide as the support is changed from alumina (Example 11) to calcium carbonate (Example 12). FIG. 3 illustrates the difference between using an alumina support (Example 13) and a calcium carbonate support (Example 14) with an iron-platinum catalyst. FIG. 4 compares an iron catalyst (Example 15) with an iron-palladium catalyst with palladium increasing in concentration from 1 ppm (Example 16) to 10 ppm (Example 17) and 100 ppm (Example 18).

The test data plainly show that the ability to convert CO to $CO_2$ increases dramatically with increasing temperature. This suggests that maintaining good catalytic activity at higher temperatures would greatly improve the ability of a catalyst to perform its intended catalytic function. The organically complexed nanocatalyst compositions of the present invention have increased stability compared to conventional nanocatalysts and would therefore be expected to provide superior combustion properties, particularly at the higher temperatures associated with most forms of combustion, compared to conventional nanocatalysts.

Example 19

Any of the foregoing fuel compositions is modified by applying the supported nanocatalyst a fuel substrate other than tobacco, including one or more of coal, briquetted charcoal, wood, biomass, and liquid-hydrocarbons.

Example 20

Any of the foregoing supported nanocatalysts is modified by omitting the solid alumina or calcium carbonate support, thereby yielding an organically complexed nanocatalyst suitable for application to a desired fuel substrate, including one or more of tobacco, coal, briquetted charcoal, wood, biomass, and liquid hydrocarbons.

Example 21

Any of the foregoing nanocatalyst compositions is modified by substituting or augmenting the iron component with one or more of chromium, manganese, cobalt, nickel, copper, zirconium, tin, zinc, tungsten, titanium, molybdenum, and vanadium, thereby yielding an organically complexed nanocatalyst suitable for application to a desired fuel substrate, including one or more of tobacco, coal, briquetted charcoal, wood, biomass, and liquid hydrocarbons.

Example 22

The following components were combined in a glass jar: 10 g iron metal powder, 3.3 g of a 70 wt. % aqueous solution of glycolic acid, 1.9 g of citric acid, 0.25 g of hydrochloric acid, 0.7 g of nitric acid, and 34.2 g of water. The mixture was placed on a shaker table and agitated for 5 days. At the completion of this process, the iron metal was fully dispersed to yield an organically complexed iron nanocatalyst composition. The mixture was stable and did not settle upon standing for several days. The complexed iron nanocatalyst composition can be applied to or mixed with any fuel substrate. The catalyst of this example was designed for application to coal in order to assist in reducing NOx when combusted in a low NOx burner by removing coal nitrogen as nitrogen gas in the low oxygen region of the burner.

Example 23

The following components were combined in a glass jar: 5 g iron metal powder, 3.3 g of a 70 wt. % aqueous solution of glycolic acid, 1.9 g of citric acid, 0.25 g of hydrochloric acid, and 39.55 g of water. The mixture was placed on a shaker table and agitated for 5 days. At the completion of this process, the iron metal was fully dispersed to yield an organically complexed iron nanocatalyst composition. The mixture was stable and did not settle upon standing for several days. The complexed iron nanocatalyst composition can be applied to or mixed with any fuel substrate. The catalyst of this example was designed for application to coal in order to assist in reducing NOx when combusted in a low NOx burner by removing coal nitrogen as nitrogen gas in the low oxygen region of the burner.

Example 24

The following components were combined in a glass jar: 5.6 g iron metal powder, 33 g of a 70 wt. % aqueous solution of glycolic acid, 19.2 g of citric acid, 55.6 g of a 0.01 wt % aqueous solution of hexachloroplatinic acid, and 200 g of water. The mixture was placed on a shaker table and agitated for 5 days. At the completion of this process, the iron metal was fully dispersed to yield an organically complexed iron-platinum nanocatalyst composition. The mixture was stable and did not settle upon standing for several days. The complexed iron-platinum nanocatalyst composition can be applied to or mixed with any fuel substrate. The catalyst of this example was designed for application to coal in order to assist in reducing NOx when combusted in a low NOx burner by removing coal nitrogen as nitrogen gas in the low oxygen region of the burner.

Example 25

The following components were combined in a glass jar: 5 g iron powder, 3.3 g of a 70 wt. % aqueous solution of glycolic acid, 1.9 g of citric acid, 5 g of a 0.01 wt. % aqueous solution of hexachloroplatinic acid, 0.125 g of hydrochloric acid, 0.35 g of nitric acid, and 34.675 g of water. The mixture was placed on a shaker table and agitated for 5 days. At the completion of this process, the iron metal was fully dispersed as an organically complexed iron nanocatalyst composition. The mixture was stable and did not settle upon standing for several days. The complexed iron-platinum nanocatalyst composition can be applied to or mixed with any fuel substrate. The catalyst of this example was designed for application to coal in order to assist in reducing NOx when combusted in a low NOx burner by removing coal nitrogen as nitrogen gas in the low oxygen region of the burner.

Example 26

The organically complexed iron nanocatalyst composition of Example 22 was applied to River Hill coal to yield a coal composition according to the invention having an iron catalyst loading of 1.5 wt. %. The coal composition was designed to assist in removing coal nitrogen as nitrogen gas in the low oxygen region of a low NOx burner in order to reduce overall NOx production during combustion. In addition, the coal composition may also have superior combustion properties compared to untreated coal (e.g., in terms of possible reductions in CO, hydrocarbons and/or soot).

Example 27

The organically complexed iron nanocatalyst composition of Example 23 was applied to River Hill coal to yield a coal composition according to the invention having an iron catalyst loading of 1.5 wt %. The coal composition was designed to assist in removing coal nitrogen as nitrogen gas in the low oxygen region of a low NOx burner in order to reduce overall NOx production during combustion. In addition, the coal composition may also have superior combustion properties compared to untreated coal (e.g. in terms of possible reductions in CO, hydrocarbons and/or soot).

Example 28

The organically complexed iron-platinum nanocatalyst composition of Example 24 was applied to River Hill coal to yield a coal composition according to the invention having an iron catalyst loading of 1.6 wt %. The coal composition was designed to assist in removing coal nitrogen as nitrogen gas in the low oxygen region of a low NOx burner in order to reduce overall NOx production during combustion. In addition, the coal composition may also have superior combustion properties compared to untreated coal (e.g., in terms of possible reductions in CO, hydrocarbons and/or soot).

Example 29

The organically complexed iron-platinum nanocatalyst composition of Example 25 was applied to River Hill coal to yield a coal composition according to the invention having an iron catalyst loading of 1.5 wt %. The coal composition was designed to assist in removing coal nitrogen as nitrogen gas in the low oxygen region of a low NOx burner in order to reduce overall NOx production during combustion. In addition, the coal composition may also have superior combustion properties compared to untreated coal (e.g., in terms of possible reductions in CO, hydrocarbons and/or soot).

Example 30

An organically complexed nanocatalyst composition was made by combining and agitating the following components until the metal was fully dissolved (i.e., there was no settling when agitation was stopped): 26.6 g of Fe(III) citrate, 200 g of water, and 33 g of a 70 wt. % glycolic acid solution. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 31

An organically complexed nanocatalyst composition was made by combining and agitating the following components until the metal was fully dissolved (i.e., there was no settling when agitation was stopped): 5.6 g of iron powder, 300 g of water, and 33 g of a 70 wt. % glycolic acid solution. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 32

An organically complexed nanocatalyst composition was made by combining and agitating the following components until the metal was fully dissolved (i.e., there was no settling when agitation was stopped): 5.6 g of iron powder, 300 g of water, 33 g of a 70 wt. % glycolic acid solution, 19.2 g of citric acid, and 21 g of a 45 wt. % polyacrylic acid solution. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 33

An organically complexed nanocatalyst composition was made by combining and agitating the following components until the metal was fully-dissolved (i.e., there was no settling when agitation was stopped): 5.6 g of iron powder, 300 g of water, 19.2 g of citric acid, and 14 g of sodium acetylacetonate. After dissolving, the mixture was heated at 100° C. for 10 minutes. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 34

An organically complexed nanocatalyst composition was made by combining and agitating the following components until the metal was fully dissolved (i.e., there was no settling when agitation was stopped): 5.6 g of iron powder, 200 g of water, 19.2 g of citric acid, and 7.2 g of polyacrylic acid (MW 2020). The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 35

An organically complexed nanocatalyst composition was made by combining and agitating the following components until the metal was fully dissolved (i.e., there was no settling when agitation was stopped): 5.6 g of iron powder, 300 g of water, 19.2 g of citric acid, and 21 g of a 45 wt. % sodium polyacrylic acid solution. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

An organically complexed nanocatalyst composition was made by combining and agitating the following components until the metal was fully dissolved (i.e., there was no settling when agitation was stopped): 5.6 g of iron powder, 200 g of water, 33 g of a 70 wt. % glycolic acid solution, and 19.2 g of citric acid. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 37

An organically complexed nanocatalyst composition was made by combining and agitating the following components until the metal was fully dissolved (i.e., there was no settling when agitation was stopped): 5.6 g of iron powder, 300 g of water, 33 g of a 70 wt. % glycolic acid solution, and 14 g of sodium acetylacetonate. The complexed iron nanocatalyst composition can be applied to or mixed with a fuel substrate to improve combustion properties. The catalyst of this example was designed, for application to coal in order to assist in reducing NOx when combusted in a low NOx burner by removing coal nitrogen as nitrogen gas in the low oxygen region of the burner.

Example 38

An organically complexed nanocatalyst composition was made by combining and agitating the following components until the metal was fully dissolved (i.e., there was no settling when agitation was stopped): 5.6 g of iron powder, 200 g of water, and 111.66 g of EDTA (disodium salt). The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 39

An organically complexed nanocatalyst composition was made by combining and agitating the following components until the metal was partially dissolved (i.e., metal did not dissolve completely): 5.6 g of iron powder, 200 g of water, and 37.2 g of EDTA (disodium salt). The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 40

An organically complexed nanocatalyst composition was made by combining and agitating the following components until the metal was fully dissolved (i.e., there was no settling when agitation was stopped): 5.6 g of iron powder, 200 g of water, 33 g of a 70 wt. % glycolic acid solution, 19.2 g of citric acid, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 41

An organically complexed nanocatalyst composition was made by combining and agitating the following components until the metal was fully dissolved (i.e., there was no settling when agitation was stopped): 26.6 g of Fe(III) citrate, 200 g of water, 33 g of a 70 wt. % glycolic acid solution, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 42

An organically complexed nanocatalyst composition was made by combining and agitating the following components until the metal was fully dissolved (i.e., there was no settling when agitation was stopped): 200 g of methanol and 35 g of Fe(III) acetylacetate. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 43

An organically complexed nanocatalyst composition was made by combining and agitating the following components until the metal was fully dissolved (i.e., there was no settling when agitation was stopped): 200 g of methanol, 35 g of Fe(III) acetylacetate, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 44

An organically complexed nanocatalyst composition was made by combining and agitating the following components until the metal was partially dissolved (i.e., metal did not dissolve completely): 200 g of water, 19.21 g of citric acid, 5.6 g of iron powder, 55.6 g of aqueous hexachloroplatinic acid (0.01 wt. % platinum), and 3.96 g of dextrose. The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 45

An organically complexed nanocatalyst composition was made by combining and agitating the following components until the metal was partially dissolved (i.e., metal did not dissolve completely): 200 g of water, 19.21 g of citric acid, 5.6 g of iron powder, and 3.96 g of dextrose. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 46

An organically complexed nanocatalyst composition was made by combining and agitating the following components until the metal was partially dissolved (i.e., metal did not dissolve completely): 200 g of water, 5.6 g of iron powder, 19.2 g of citric acid, and 2.8 g of sodium acetylacetonate. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 47

An organically complexed nanocatalyst composition was made by combining and agitating the following components until the metal was fully dissolved (i.e., there was no settling when agitation was stopped): 200 g of water, 5.6 g of iron powder, 19.2 g of citric acid, 2.8 g of sodium acetylacetonate, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner, by removing coal nitrogen as nitrogen gas in the low oxygen region of the burner.

Example 48

An organically complexed nanocatalyst composition was made by combining and agitating the following components until the metal was partially dissolved (i.e., metal did not dissolve completely): 5.6 g of iron powder, 200 g of water, 33 g of a 70 wt. % glycolic acid solution, 19.2 g of citric acid, and 4.2 g of a 45 wt. % aqueous solution of polyacrylic acid. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 49

An organically complexed nanocatalyst composition was made by combining and agitating the following components until the metal was fully dissolved (i.e., there was no settling when agitation was stopped): 5.6 g of iron powder, 200 g of water, 33 g of a 70 wt. % glycolic acid solution, 19.2 g of citric acid, 4.2 g of a 45 wt. % aqueous solution of polyacrylic acid, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 50

An organically complexed nanocatalyst composition was made by combining and agitating the following components until the metal was partially dissolved (i.e., metal did not dissolve completely): 200 g of water, 5.6 g of iron powder, 19.2 g of citric acid, 2.8 g of sodium acetylacetonate, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 51

An organically complexed nanocatalyst composition was made by combining and agitating the following components until the metal was partially dissolved (i.e., metal did not dissolve completely): 5.6 g of iron powder, 200 g of water, 33 g of a 70 wt. % glycolic acid solution, 19.2 g of citric acid, 4.2 g of a 45 wt. % aqueous solution of polyacrylic acid, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 52

An organically complexed nanocatalyst composition was made by combining and agitating the following components until the metal was partially dissolved (i.e., metal did not dissolve completely): 5.6 g of iron powder, 200 g of water, 33 g of a 70 wt. % glycolic acid solution, 19.2 g of citric acid, and 55.6 g of aqueous hexachloroplatinic acid (0.01 wt. % platinum). The complexed iron-platinum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 53

An organically complexed nanocatalyst composition was made by combining and agitating the following components until the metal was fully dissolved (i.e., there was no settling when agitation was stopped): 200 g of water, 5.56 g of iron powder, 4.8 g of citric acid, 33 g of a 70 wt. % glycolic acid solution, and 0.265 g of vanadyl acetylacetonate. The complexed iron-vanadium nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 54

An organically complexed nanocatalyst composition was made by combining and agitating the following components until the metal was fully dissolved (i.e., there was no settling when agitation was stopped): 200 g of water, 5.56 g of iron powder, 4.8 g of citric acid, 33 g of a 70 wt. % glycolic acid solution, and 0.2499 g of tungstic acid. The complexed iron-tungsten nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 55

An organically complexed nanocatalyst composition was made by combining and agitating the following components until the metal was fully dissolved (i.e., there was no settling when agitation was stopped): 200 g of water, 5.56 g of iron powder, 4.8 g of citric acid, 33 g of a 70 wt. % glycolic acid solution, and 0.1816 g of copper(II) acetate. The complexed iron-copper nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 56

An organically complexed nanocatalyst composition was made by combining and agitating the following components until the metal was fully dissolved (i.e., there was no settling when agitation was stopped): 200 g of water, 5.56 g of iron powder, 4.8 g of citric acid, 33 g of a 70 wt. % glycolic acid solution, and 0.190 g of lanthanum hydroxide. The complexed iron-lanthanum nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 57

An organically complexed nanocatalyst composition was made by combining and agitating the following components until the metal was fully dissolved (i.e., there was no settling when agitation was stopped): 200 g of water, 5.56 g of iron powder, 4.8 g of citric acid, 33 g of a 70 wt. % glycolic acid solution, and 0.249 g of manganese (II) acetate. The complexed iron-manganese nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 58

An organically complexed nanocatalyst composition was made by combining and agitating the following components until the metal was fully dissolved (i.e., there was no settling when agitation was stopped): 200 g of water, 5.56 g of iron powder, 4.8 g of citric acid, 33 g of a 70 wt. % glycolic acid solution, 0.190 g of lanthanum hydroxide, 0.182 g of copper (II) acetate, and 0.245 g of manganese(II) acetate. The complexed iron-lanthanum-copper-manganese nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 59

An organically complexed nanocatalyst composition was made by combining and agitating the following components until the metal was fully dissolved (i.e., there was no settling when agitation was stopped): 0.200 g of water, 5.56 g of iron powder, 4.8 g of citric acid, 33 g of a 70 wt. % glycolic acid solution, 0.25 g of tungstic acid, and 0.265 g of vanadyl acetylacetonate. The complexed iron-tungsten-vanadium nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 60

An organically complexed nanocatalyst composition was made by combining and agitating the following components until the metal was fully dissolved (i.e., there was no settling when agitation was stopped): 200 g of water, 5.56 g of iron powder, 4.8 g of citric acid, and 33 g of a 70 wt. % glycolic acid solution. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 61

An organically complexed nanocatalyst composition was made by combining and agitating the following components until the metal was fully dissolved (i.e., there was no settling when agitation was stopped): 10 g of iron powder, 0.25 g aqueous hydrochloric acid (37 wt. %), 3.3 g of a 70 wt. % glycolic acid solution, 1.9 g of citric acid, 34.55 g of water, and 0.35 g aqueous nitric acid (70 wt. %). The complexed iron nanocatalyst composition can be applied to or mixed with a fuel substrate to improve combustion properties. The catalyst of this example was designed for application to coal in order to assist in reducing NOx when combusted in a low NOx burners by removing coal nitrogen as nitrogen gas in the low oxygen region of the burner.

Example 62

An organically complexed nanocatalyst composition was made by combining and agitating the following components until the metal was fully dissolved (i.e., there was no settling when agitation was stopped): 5 g of iron powder, 0.125 g aqueous hydrochloric acid (37 wt. %), 3.3 g of a 70 wt. % glycolic acid solution, 1.9 g of citric acid, 39.675 g of water, and 0.35 g aqueous nitric acid (70 wt. %). The complexed iron nanocatalyst composition can be applied to or mixed with a fuel substrate to improve a combustion properties. The catalyst of this example was designed for application to coal in order to assist in reducing NOx when combusted in a low NOx burner by removing coal nitrogen as nitrogen gas in the low oxygen region of the burner.

Example 63

An organically complexed nanocatalyst composition was made by combining and agitating the following components until the metal was fully dissolved (i.e., there was no settling when agitation was stopped): 10 g of iron powder, 0.7 g aqueous nitric acid (70 wt. %), 3.3 g of a 70 wt. % glycolic acid solution, 1.9 g of citric acid, and 34.45 g of water. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 64

An organically complexed nanocatalyst composition was made by combining and agitating the following components until the metal was fully dissolved (i.e., there was no settling when agitation was stopped): 5 g of iron powder, 0.525 g aqueous nitric acid (70 wt. %), 3.3 g of a 70 wt. % glycolic acid solution, 1.9 g of citric acid, and 39.625 g of water. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 65

An organically complexed nanocatalyst composition was made by combining and agitating the following components until the metal was fully dissolved (i.e., there was no settling when agitation was stopped): 10 g of iron powder, 0.25 g aqueous hydrochloric acid (37 wt. %), 0.7 g aqueous nitric acid (70 wt. %), 3.3 g of a 70 wt. % glycolic acid solution, 1.9 g of citric acid, and 34.20 g of water. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 66

An organically complexed nanocatalyst composition was made by combining and agitating the following components until the metal was fully dissolved (i.e., there was no settling when agitation was stopped): 10 g of iron powder, 0.5 g aqueous hydrochloric acid (37 wt. %), 3.3 g of a 70 wt. % glycolic acid solution, 1.9 g of citric acid, and 34.3 g of water. The complexed iron, nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 67

An organically complexed nanocatalyst composition was made by combining and agitating the following components until the metal was fully dissolved (i.e., there was no settling when agitation was stopped): 5 g of iron powder, 0.25 g aqueous hydrochloric acid (37 wt. %), 3.3 g of a 70 wt. % glycolic acid solution, 1.9 g of citric acid, and 39.55 g of water. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 68

An organically complexed nanocatalyst composition was made by combining and agitating the following components until the metal was fully dissolved (i.e., there was no settling when agitation was stopped): 10 g of iron powder, 0.7 g aqueous hydrochloric acid (37 wt. %), 3.3 g of a 70 wt. % glycolic acid solution, 1.9 g of citric acid, and 34.1 g of water. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 69

An organically complexed nanocatalyst composition was made by combining and agitating the following components until the metal was fully dissolved (i.e., there was no settling when agitation was stopped): 5 g of iron powder, 0.35 g aqueous nitric acid (70 wt. %), 3.3 g of a 70 wt. % glycolic acid solution, 1.9 g of citric acid, and 39.45 g of water. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Example 70

An organically complexed nanocatalyst composition was made by combining and agitating the following components until the metal was fully dissolved (i.e., there was no settling when agitation was stopped): 10 g of iron powder, 0.7 g concentrated nitric acid [??], 0.5 g aqueous hydrochloric acid (37 wt. %), 3.3 g of a 70 wt. % glycolic acid solution, 1.9 g of citric acid, and 33.6 g of water. The complexed iron nanocatalyst composition can be applied to or mixed with a fuel substrate to improve combustion properties. The catalyst of this example was designed for application to coal in order to assist in reducing NOx when combusted in a low NOx burner by removing coal nitrogen as nitrogen gas in the low oxygen region of the burner.

Examples 71-108

Examples 71-108 describe a number of organically complexed nanocatalyst compositions that can be applied to or mixed with a fuel substrate to improve combustion properties. Such compositions were designed for application to coal in order to assist in reducing NOx when combusted in a low NOx burner by removing coal nitrogen as nitrogen gas in the low oxygen region of the burner.

The organically complexed nanocatalyst compositions were made according to the following procedure: a metal complexing solution was made by mixing together mineral acid components (i.e., aqueous hydrochloric acid (37%) and/or aqueous nitric acid (70%), dispersing agents (i.e., aqueous glycolic acid (70%) and/or citric acid, and/or ethylene glycol), and 5 wt. % of the de-ionized water in a first container. The remaining de-ionized water was placed into a high shear mixing vessel and the mixer ramped up to 5400 RPM. The iron powder was gradually added to the mixing vessel with continued mixing. The complexing solution was slowly added to the mixing vessel over the course of five minutes to inhibit foaming and rapid temperature increase. Mixing was maintained for 60 hours for each of Examples 71-101 and 107 (4, 2, 2, 6, 6 and 6 hours, respectively, for each of Examples 102-106 and 108), while purging the vessel with nitrogen, to form the organically complexed nanocatalyst compositions.

The components and the amounts of each component measured in grams used to form the organically complexed nanocatalyst compositions of Examples 71-108 are set forth in Table I below:

TABLE I

| | COMPONENTS (g) | | | | | | |
|---|---|---|---|---|---|---|---|
| Example | Iron | HCl | $HNO_3$ | Glycolic Acid | Citric Acid | Ethylene Glycol | De-ionized Water |
| 71 | 1500 | 38 | 105 | 165 | 285 | 0 | 5408 |
| 72 | 1500 | 75 | 105 | 165 | 285 | 0 | 5370 |
| 73 | 1500 | 38 | 105 | 165 | 0 | 0 | 5693 |
| 74 | 1500 | 38 | 105 | 0 | 285 | 0 | 5573 |
| 75 | 1500 | 38 | 105 | 660 | 285 | 0 | 4913 |
| 76 | 3000 | 75 | 210 | 495 | 195 | 0 | 3525 |
| 77 | 1500 | 38 | 105 | 54 | 143 | 0 | 5561 |
| 78 | 1500 | 45 | 105 | 0 | 285 | 0 | 5565 |
| 79 | 1500 | 38 | 113 | 0 | 285 | 0 | 5565 |
| 80 | 1500 | 45 | 105 | 108 | 0 | 0 | 5742 |

TABLE I-continued

| | COMPONENTS (g) | | | | | | |
|---|---|---|---|---|---|---|---|
| Example | Iron | HCl | $HNO_3$ | Glycolic Acid | Citric Acid | Ethylene Glycol | De-ionized Water |
| 81 | 1500 | 38 | 113 | 108 | 0 | 0 | 5742 |
| 82 | 1500 | 38 | 113 | 54 | 0 | 0 | 5654 |
| 83 | 2250 | 56 | 169 | 0 | 428 | 0 | 4598 |
| 84 | 2250 | 60 | 158 | 0 | 428 | 0 | 4605 |
| 85 | 1500 | 38 | 113 | 81 | 143 | 0 | 5627 |
| 86 | 1500 | 38 | 113 | 54 | 210 | 0 | 5586 |
| 87 | 1500 | 38 | 113 | 0 | 0 | 225 | 5625 |
| 88 | 1500 | 38 | 105 | 0 | 0 | 113 | 5745 |
| 89 | 1500 | 0 | 38 | 0 | 0 | 150 | 5813 |
| 90 | 1500 | 0 | 38 | 8 | 15 | 150 | 5790 |
| 91 | 2250 | 56 | 169 | 162 | 0 | 0 | 4863 |
| 92 | 2250 | 56 | 169 | 81 | 214 | 0 | 4730 |
| 93 | 2250 | 0 | 56 | 2 | 11 | 225 | 4955 |
| 94 | 3000 | 75 | 210 | 0 | 570 | 0 | 3645 |
| 95 | 3750 | 0 | 113 | 0 | 0 | 450 | 3188 |
| 96 | 3750 | 94 | 281 | 270 | 0 | 0 | 3105 |
| 97 | 4500 | 113 | 338 | 162 | 428 | 0 | 3461 |
| 98 | 3200 | 80 | 240 | 230 | 0 | 0 | 4250 |
| 99 | 3200 | 80 | 240 | 115 | 304 | 0 | 4061 |
| 100 | 3200 | 80 | 240 | 0 | 608 | 0 | 3872 |
| 101 | 3600 | 90 | 270 | 259 | 0 | 0 | 4781 |
| 102 | 5100 | 136 | 357 | 0 | 969 | 0 | 10438 |
| 103 | 6400 | 160 | 480 | 0 | 1216 | 0 | 7744 |
| 104 | 6400 | 160 | 480 | 461 | 0 | 0 | 8499 |
| 105 | 8000 | 120 | 360 | 346 | 0 | 0 | 7174 |
| 106 | 6000 | 150 | 450 | 432 | 0 | 0 | 7968 |
| 107 | 3600 | 90 | 270 | 259 | 0 | 0 | 4781 |
| 108 | 6400 | 160 | 480 | 461 | 0 | 0 | 8499 |

Examples 109-115

Examples 109-115 describe a number of organically complexed nanocatalyst compositions that can be applied to or mixed with a fuel substrate to improve combustion properties. Such compositions were designed for application to coal in order to assist in reducing NOx when combusted in a low NOx burner by removing coal nitrogen as nitrogen gas in the low oxygen region of the burner.

The organically complexed nanocatalyst compositions were made according to the following procedure: a metal complexing solution was made by mixing together mineral acid components (i.e., aqueous hydrochloric acid (37%) and/or aqueous nitric acid (70%)), aqueous glycolic acid (70%), and de-ionized water in a high shear mixer at 100 RPM. A mixture of iron powder and citric acid powder was added; to the mixing vessel with continued mixing. Mixing continued between 200 and 4000 RPM, while purging the vessel with nitrogen, to form the organically complexed nanocatalyst compositions.

The components, the amounts of each component measured in weight percent, and the mixing times used to form the organically complexed nanocatalyst compositions of Examples 109-115 were as follows:

TABLE II

| | COMPONENTS (wt. %) | | | | | | |
|---|---|---|---|---|---|---|---|
| Example | Iron | HCl | $HNO_3$ | Glycolic Acid | Citric Acid | Deionized Water | Mixing Time |
| 109 | 10 | 0.25 | 0.70 | 6.60 | 3.80 | 78.65 | 99 |
| 110 | 20 | 0.25 | 0.70 | 6.60 | 3.80 | 68.65 | 96 |
| 111 | 20 | 0.25 | 0.70 | 6.60 | 3.80 | 68.65 | 168 |

TABLE II-continued

| Example | COMPONENTS (wt. %) | | | | | | |
|---|---|---|---|---|---|---|---|
| | Iron | HCl | $HNO_3$ | Glycolic Acid | Citric Acid | Deionized Water | Mixing Time |
| 112 | 20 | 0.5 | 1.40 | 6.60 | 3.80 | 67.70 | 125 |
| 113 | 10 | 0.5 | 1.40 | 6.60 | 3.80 | 77.70 | 53 |
| 114 | 20 | 0.5 | 1.40 | 6.60 | 3.80 | 67.70 | 54 |
| 115 | 20 | 0.5 | 1.40 | 6.60 | 3.80 | 67.70 | 32 |

The following examples show results from a bench-scale pre-combustion test that was performed in order to preliminarily test the concept that applying or mixing an organically complexed nanocatalyst composition with coal would assist in the removal of coal nitrogen in a low oxygen zone of a conventional low NOx coal burner. The examples demonstrate that complexed nanocatalysts according to the invention were useful in increasing coal nitrogen removal at high temperature and low oxygen relative to untreated coal.

The pre-combustion test apparatus was a LECO TGA-601 analyzer, which included four major parts: 1) a coal feeder, 2) a combustion chamber, 3) an electric furnace, and 4) off gas analyzers. The combustion chamber utilized a ceramic vessel that fit inside a protective outer stainless steel chamber to act as a liner to eliminate the catalytic effects of stainless steel. Sweep gas, made up of air and argon, was metered and swept past the end of a coal auger from which coal entered the gas mixture. The mixture of coal, air and argon were then dropped into the ceramic combustion chamber located inside the electric furnace. A thermocouple inserted into the ceramic chamber recorded the temperature.

As the mixture of air, argon and coal entered the heated combustion chamber, the coal ignited. As the coal devolatilized, the heavier ash particles fell to the bottom of the chamber and were collected after the experiment ended. The off gases, with any entrained ash particles, passed from the ceramic chamber to a particulate trap to remove the ash material. The clean gases flowed through a series of moisture traps designed to remove any water vapors and tars. After removing these substances, the gas flowed to a gas analyzer to measure NOx.

Examples 116-119

Examples 116-119 show the results of the pre-combustion study relative to the organically complexed nanocatalyst compositions of Examples 22-25, which were used to make the coal compositions of Examples 26-29. The catalyst compositions of Examples 22-25 were applied to coal in pulverized form to form the coal compositions of Examples 26-29.

Approximately 2.5 grams of a pulverized coal/catalyst mixture made using the nanocatalyst compositions of Examples 22-25 were loaded into the LECO TGA-601 apparatus and heated to 107° C. for 30 minutes in an argon environment. The apparatus was programmed to ramp at 43° C. per minute up to 950° C. and then hold that temperature for 60 minutes, all in an argon environment. After subsequent cooling, the coal char samples were recovered from the apparatus and analyzed in a CHN analyzer. This allows the percentage of coal nitrogen released during pyrolysis to be determined.

Comparative Example 1

In order to provide a baseline from which to analyze the effect of applying an organically complexed nanocatalyst material to coal (i.e., River Hill coal), untreated River Hill coal (a Pittsburgh 8 bituminous coal) was tested using the LECO TGA-601 analyzer according to the method described above. CHN analysis of the coal char material indicated that 30.67% of the coal nitrogen was released to gaseous products.

Example 116

The coal composition of Example 26 was tested using the LECO TGA-601 analyzer according to the method described above. CHN analysis of the coal char indicated that 41.2% of the coal nitrogen was released to gaseous products. This is an increase in nitrogen release of 34.3% relative to Comparative Example 1.

Example 117

The coal composition of Example 27 was tested using the LECO TGA-601 analyzer according to the method described, above. CHN analysis of the coal char indicated that 42.6% of the coal nitrogen was released to gaseous products. This is an increase in nitrogen release of 38.9% relative to Comparative Example 1.

Example 118

The coal composition of Example 28 was tested using the LECO TGA-601; analyzer according to the method described above. CHN analysis of the char indicated that 44.1% of the coal nitrogen was released to gaseous products. This is an increase in nitrogen release of 43.8% relative to Comparative Example 1.

Example 119

The coal composition of Example 28 was tested using the LECO TGA-601 analyzer according to the method described above. CHN analysis of the coal char indicated that 43.2% of the coal nitrogen was released to gaseous products This is an increase in nitrogen release of 40.8% relative to Comparative Example 1.

The results of the pre-combustion test indicate that the four nanocatalyst compositions described in Examples 116-119 were effective in substantially increasing the release of coal nitrogen from coal in a low oxygen pre-combustion setting. This suggests that coal treated using such nanocatalyst compositions would be expected to increase the release of coal nitrogen within the low oxygen, pre-combustion zone of a low NOx coal burner.

Even though most of the exemplary organically complexed nanocatalyst compositions set forth in the examples were not rigorously tested to determine if they would definitively work to reduce NOx production during coal combustion in a low NOx burner, one of skill in the art will readily understand that many, if not most, of such compositions might be expected to work in this manner. Moreover, many, if not all, of the exemplary catalyst compositions should be expected to enhance at least some aspect of combustion of a carbon-containing fuel (e.g., in increasing combustion efficiency in order to reduce the amount of CO, hydrocarbons and/or soot that is produced during combustion of a nanocatalyst treated fuel composition).

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A fuel composition having modified combustion properties, comprising:

a fuel substrate comprising at least one member selected from the group consisting of tobacco, coal, briquetted charcoal, wood, biomass, fuel oil, diesel, jet fuel, gasoline, and distilled liquid hydrocarbons;

a plurality of organically complexed metal catalyst nanoparticles on and/or mixed with said fuel substrate, said metal catalyst nanoparticles having a size less than 1 micron, each organically complexed metal catalyst nanoparticle consisting essentially of:

a plurality of active catalyst atoms, at least about 50% of which comprise one or more types of primary catalyst atoms selected from the group consisting of chromium, manganese, iron, cobalt, nickel, copper, zirconium, tin, zinc, tungsten, titanium, molybdenum, and vanadium; and a dispersing agent consisting essentially of a plurality of organic molecules complexed with at least a portion of said active catalyst atoms of said metal catalyst nanoparticles, each of said organic molecules having one or more functional groups capable of bonding to said active catalyst atoms, wherein the organic molecules are bonded to the metal catalyst nanoparticles, wherein the organic molecules are selected from the group consisting of formic acid, acetic acid, oxalic acid, malonic acid, glycolic acid, glucose, citric acid, and glycine.

2. A fuel composition as defined in claim 1, said primary catalyst atoms being selected from the group consisting of nickel, cobalt, manganese, vanadium, copper, zinc, and combinations thereof.

3. A fuel composition as defined in claim 1, said primary catalyst atoms comprising iron.

4. A fuel composition as defined in claim 1, said nanocatalyst particles having a size less than about 300 nm.

5. A fuel composition as defined in claim 1, said nanocatalyst particles having a size less than about 100 nm.

6. A fuel composition as defined in claim 1, said nanocatalyst particles comprising less than about 2.5% by weight of the fuel composition.

7. A fuel composition as defined in claim 1, said nanocatalyst particles comprising less than about 1.5% by weight of the fuel composition.

8. A fuel composition as defined in claim 1, said active catalyst atoms of said organically complexed nanocatalyst particles further comprising one or more types of minority catalyst atoms, different from said primary catalyst atoms, selected from the group consisting of ruthenium, palladium, silver, platinum, nickel, cobalt, vanadium, chromium, copper, zinc, molybdenum, tin, manganese, gold, rhodium, zirconium, tungsten, rhenium, osmium, iridium, titanium, and cerium.

9. A fuel composition as defined in claim 1, said one or more functional groups being selected from the group consisting of a hydroxyl, a carboxyl, a carbonyl, an amine, an amide, a nitrogen having a free lone pair of electrons, an amino acid, a thiol, a sulfonic acid, a sulfonyl halide, and an acyl halide.

10. A fuel composition as defined in claim 1, wherein the organic molecules comprise at least one of glycolic acid or citric acid.

11. A method of increasing combustion efficiency of the fuel composition of claim 1 comprising combusting said fuel composition in the presence of oxygen, the active catalyst atoms catalyzing more efficient and/or thorough combustion of said fuel substrate.

12. A method of manufacturing a fuel composition having modified combustion properties, comprising:

reacting together a plurality of active catalyst metal atoms and a dispersing agent to yield an intermediate catalyst complex, at least about 50% of said active catalyst metal atoms comprising one or more types of primary catalyst atoms selected from the group consisting of chromium, manganese, iron, cobalt, nickel, copper, zirconium, tin, zinc, tungsten, titanium, molybdenum, and vanadium, said dispersing agent consisting essentially of a plurality of organic molecules complexed with at least a portion of said active catalyst metal atoms, each of said organic molecules having one or more functional groups capable of bonding to said active catalyst metal atoms, wherein the organic molecules are selected from the group consisting of formic acid, acetic acid, oxalic acid, malonic acid, glycolic acid, glucose, citric acid, and glycine, causing or allowing the intermediate catalyst complex to form organically complexed metal catalyst nanoparticles having a size less than about 1 micron, the organically complexed metal catalyst nanoparticles consisting essentially of the catalyst metal atoms and the organic molecules; and combining said organically complexed metal catalyst nanoparticles with a fuel substrate, the fuel substrate comprising at least one member selected from the group consisting of tobacco, coal, briquetted charcoal, wood, biomass, fuel oil, diesel, jet fuel, gasoline, and distilled liquid hydrocarbons.

13. A method of manufacturing a fuel composition as defined in claim 12, said catalyst complex forming said organically complexed metal catalyst nanoparticles prior to being combined with said fuel substrate.

14. A method of manufacturing a fuel composition as defined in claim 12, said organically complexed metal catalyst nanoparticles particles having a size less than about 100 nm.

15. A method of manufacturing a fuel composition as defined in claim 12, said active catalyst atoms of said organically complexed metal catalyst nanoparticles further comprising one or more types of minority catalyst atoms, different from said primary catalyst atoms, selected from the group consisting of ruthenium, palladium, silver, platinum, nickel, cobalt, vanadium, chromium, copper, zinc, molybdenum, tin, manganese, gold, rhodium, zirconium, tungsten, rhenium, osmium, iridium, titanium, and cerium.

16. A method of manufacturing a fuel composition as defined in claim 13, said organically complexed metal catalyst nanoparticles being dispersed in a solvent so as to form a nanocatalyst suspension.

17. A method of manufacturing a fuel composition as defined in claim 16, said nanoparticle suspension having a nanoparticle concentration greater than about 1% by weight of said suspension.

18. A method of manufacturing a fuel composition as defined in claim 16, said nanoparticle suspension having a nanoparticle concentration greater than about 5% by weight of said suspension.

19. A method of manufacturing a fuel composition as defined in claim 16, said solvent comprising water.

20. A method of manufacturing a fuel composition as defined in claim 16, wherein said nanoparticle suspension is stable such that it can be stored and transported without substantial agglomeration of said organically complexed nanocatalyst particles prior to application to said fuel substrate.

21. A fuel composition manufactured according to the method of claim 12.

22. A method of manufacturing a fuel composition as defined in claim 12, said intermediate catalyst complex being formed in an aqueous solution.

23. A method of manufacturing a fuel composition as defined in claim 22, said aqueous solution further comprising at least one of a mineral acid, a base, or ion exchange resin.

24. A method of making a fuel composition as defined in claim 12, wherein said intermediate catalyst complex is foamed by:

mixing together iron, a solvent, and said dispersing agent;

reacting said iron with said dispersing agent to yield an iron catalyst complex as said intermediate catalyst complex; and causing or allowing said iron catalyst complex to form organically complexed iron-based catalyst nanoparticles having a size less than about 1 micron.

25. A method of making a fuel composition as defined in claim 24, further comprising removing at least a portion of said solvent to yield concentrated or dried organically complexed iron-based nanocatalyst.

26. A method of making a fuel composition as defined in claim 25, further comprising mixing said concentrated or dried organically complexed iron-based nanocatalyst with additional solvent.

27. A method of making a fuel composition as defined in claim 12, wherein the organic molecules comprise at least one of glycolic acid or citric acid.

28. A fuel composition having modified combustion properties, comprising:

a solid fuel substrate comprising at least one of coal, briquetted charcoal, wood, or biomass; and a plurality of organically complexed metal catalyst nanoparticles on and/or mixed with said solid fuel substrate, said metal catalyst nanoparticles having a size less than 1 micron, each metal catalyst nanoparticle consisting essentially of:

a plurality of active catalyst atoms, at least about 50% of which comprise one or more types of primary catalyst atoms selected from the group consisting of chromium, zirconium, tin, tungsten, titanium, molybdenum, iron, nickel, cobalt, manganese, vanadium, copper, and zinc; and a dispersing agent consisting essentially of a plurality of organic molecules complexed with at least a portion of said active catalyst atoms of said metal catalyst nanoparticles, each of said organic molecules having one or more functional group capable of bonding to said active catalyst atoms, wherein the organic molecules are bonded to the metal catalyst nanoparticles, wherein the organic molecules are selected from the group consisting of formic acid, acetic acid, oxalic acid, malonic acid, glycolic acid, glucose, citric acid, and glycine, and wherein said dispersing agent forms a bond between at least some of said metal catalyst nanoparticles and said solid fuel substrate.

29. A fuel composition as defined in claim 28, said metal catalyst nanoparticles consisting essentially of iron.

30. A fuel composition as defined in claim 28, said iron of said metal catalyst nanoparticles comprising less than about 2.5% by weight of the coal composition.

31. A fuel composition as defined in claim 28, said iron of said metal catalyst nanoparticles comprising less than about 1.5% by weight of the coal composition.

* * * * *

UNITED STATES PATENT AND TRADEMARK OFFICE

CERTIFICATE OF CORRECTION

PATENT NO. : 7,803,201 B2
APPLICATION NO. : 11/104324
DATED : September 28, 2010
INVENTOR(S) : Zhou et al.

It is certified that error appears in the above-identified patent and that said Letters Patent is hereby corrected as shown below:

Cover page

Item 56, References Cited, OTHER PUBLICATIONS, Page 1, Right Hand Column, line 1, change the reference "Z. Wu and Y. Ohtsuka, Key Factors for Formation of N2 from Low-Rank Coals during Fixed Bed Pyrolysis: Pyrolysis Conditions and Inherent Minerals, 11 Energy & Fuels 902-908 (1997).*" to --Z. Wu and Y. Ohtsuka, Key Factors for Formation of $N_2$ from Low-Rank Coals during Fixed Bed Pyrolysis: Pyrolysis Conditions and Inherent Minerals, 11 Energy & Fuels 902-908 (1997).*--

Item 56, References Cited, OTHER PUBLICATIONS, Page 2, Right Hand Column, line 4, change the reference "Wang, H.P., et al., "Spectroscopic Studies of Coal Maceral Depolymerization Effected by an Iron-Based Catalystl" U.S. Department of Energy 1992, http://www-acerc.byu.edu/Abstracts/19. (1992)." to --Wang, H.P., et al., "Spectroscopic Studies of Coal Maceral Depolymerization Effected by an Iron-Based Catalyst" U.S. Department of Energy 1992, http://www-acerc.byu.edu/Abstracts/19. (1992).--

Item 56, References Cited, OTHER PUBLICATIONS, Page 2, Right Hand Column, line 8, change the reference "Asami, Kenji, et al., "Highly Active Iron Catalysts from Ferrie Chloride for the Steam Gasification of Brown Coal" *American Chemical Society*, Ind. Eng. Chem. Res. 1993, 32, pp. 1631-1636." to --Asami, Kenji, et al., "Highly Active Iron Catalysts from Ferric Chloride for the Steam Gasification of Brown Coal" *American Chemical Society*, Ind. Eng. Chem. Res. 1993, 32, pp. 1631-1636.--

Item 56, References Cited, OTHER PUBLICATIONS, Page 2, Right Hand Column, line 32, change the reference "Wu, Zhiheng, et al., "Key Factors for Formation of $N_2$ from Low-Rank Coals during Fixed Bed Pyrolysis: Pryolysis Conditions and Inherent Minerals" Institute for Chemical Reaction Science, Tohoku University, Sendai, Japan, pp. 902-908 (Feb. 4, 1997)." to --Wu, Zhiheng, et al., "Key Factors for Formation of $N_2$ from Low-Rank Coals during Fixed Bed Pyrolysis: Pyrolysis Conditions and Inherent Minerals" Institute for Chemical Reaction Science, Tohoku University, Sendai, Japan, pp. 902-908 (Feb. 4, 1997).--

Item 56, References Cited, OTHER PUBLICATIONS, Page 2, Right Hand Column, line 36, change the reference "Ohtsuka, Yasuo, et al., "Char-Nitrogen Functionality and Interactions between the Nitrogen and Iron in the Iron-Catalyzed Conversion Process of Coal Nitrogen to $N_2$" Research Signed and Sealed this
Fifteenth Day of March, 2011

David J. Kappos

David J. Kappos
*Director of the United States Patent and Trademark Office*

Center for Organic Resources and Material s Chemistry, Institute for Chemical Reaction Science, Tohoku University, Sendai, Japan, pp. 1356-1362, (May 6, 1998)." to --Ohtsuka, Yasuo, et al., "Char-Nitrogen Functionality and Interactions between the Nitrogen and Iron in the Iron-Catalyzed Conversion Process of Coal Nitrogen to $N_2$" Research Center for Organic Resources and Materials Chemistry, Institute for Chemical Reaction Science, Tohoku University, Sendai, Japan, pp. 1356-1362, (May 6, 1998).--

Column 1
Line 33, after "is" insert --a--

Column 2
Line 6, change "an" to --a--

Column 4
Line 53, change "catalyst" to --Catalyst--
Line 62, before "nitrogen" insert --a--
Line 63, before "sulfonyl" insert --a--

Column 5
Line 20, change "hetoratoms" to --heteroatoms--

Column 6
Line 52, after "material" insert --.--

Column 7
Line 29, change "zirconian" to --zirconium--

Column 8
Line 26, change "functional-groups" to --functional groups--
Line 57, change "suflobenzoic" to --sulfobenzoic--

Column 10
Line 42, change "easy" to --easily--

Column 12
Line 41, change "hydrocarbond" to --hydrocarbon--

Column 13
Line 9, after "one or" insert --more--
Line 32, change "positioning," to --positioning--
Line 33, change "gasses" to --gases--
Line 33, after "smoke" insert -- so--

Column 14
Line 56, change "is" to --are--

Column 15
Line 63, remove [a]

Column 17
Line 25, after “precipitate” insert --was--

Column 19
Line 20, change “shows” to --show--
Line 49, change “liquid-hydrocarbons” to --liquid hydrocarbons--

Column 23
Between lines 28 and 29, insert --Example 36--

Column 29
Line 14, change “burners” to --burner--
Line 27, remove [a]

Column 30
Line 20, change “iron,” to --iron--

Column 31
Line 11, remove [[??]]

Column 32
Line 48, change “added;” to --added--

Column 33
Line 25, change “fit” to --fits--

Column 34
Line 19, change “described,” to --described--
Line 28, change “LECO TGA-601;” to --LECO TGA-601--
Line 39, change “products This” to --products. This--

Column 36
Line 44, after “nanoparticles” delete “particles”

Column 37
Line 19, change “foamed” to --formed--

Column 38
Line 20, change “group” to --groups--